US008561858B2

(12) United States Patent
Vachon

(10) Patent No.: US 8,561,858 B2
(45) **Date of Patent: *Oct. 22, 2013**

(54) AUTO-VENTED AUTOMATIC STOP FLOW POURING SPOUT

(71) Applicant: Leandre Vachon, Thetford Mines (CA)

(72) Inventor: Leandre Vachon, Thetford Mines (CA)

(73) Assignee: Le Groupe DSD Inc., Thetford Mines, Québec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/804,445

(22) Filed: Mar. 14, 2013

(65) Prior Publication Data

US 2013/0193165 A1 Aug. 1, 2013

Related U.S. Application Data

(63) Continuation of application No. 12/677,863, filed as application No. PCT/CA2008/001605 on Sep. 10, 2008, now Pat. No. 8,403,185.

(30) Foreign Application Priority Data

Sep. 12, 2007 (CA) ..... 2601607

(51) Int. Cl.
*B67D 3/00* (2006.01)

(52) U.S. Cl.
USPC ..... 222/484; 222/153.01; 222/153.14; 222/481.5; 222/523; 222/539; 222/566; 222/568; 141/309

(58) Field of Classification Search
USPC ..... 222/481.5, 484, 518, 522–523, 525, 222/539, 566–568, 153.01, 153.05–153.07, 222/153.14; 141/309, 311 R, 319–322, 351
See application file for complete search history.

(56) References Cited

U.S. PATENT DOCUMENTS

| | | | | |
|---|---|---|---|---|
| 4,746,036 | A | 5/1988 | Messner | |
| 4,958,668 | A | 9/1990 | Vachon | |
| 5,228,487 | A | 7/1993 | Thiermann et al. | |
| 5,249,611 | A * | 10/1993 | Law | 141/198 |
| 5,406,994 | A | 4/1995 | Mitchell et al. | |
| 5,419,378 | A * | 5/1995 | Law | 141/198 |
| 5,507,328 | A | 4/1996 | Donovan | |
| 5,560,522 | A | 10/1996 | Clark | |
| 5,628,352 | A | 5/1997 | Gracyalny et al. | |
| 5,762,117 | A * | 6/1998 | Law | 141/198 |

(Continued)

FOREIGN PATENT DOCUMENTS

EP 0112938 A2 7/1984

*Primary Examiner* — Frederick C Nicolas
(74) *Attorney, Agent, or Firm* — IPAXIO S.E.N.C.

(57) ABSTRACT

The pouring spout includes a first tube detachably connectable to a liquid-storage container, a second tube slideably connected to the first tube, and a liquid outlet duct and an air inlet duct. The liquid outlet duct and the air inlet duct can be both selectively opened and closed by a spring-biased valve system. The air inlet duct, when the valve system is moved from a closed position to an opened position, is initially made in fluid communication with the liquid-storage container only either simultaneously with the liquid outlet duct or immediately after the liquid outlet duct is initially made in fluid communication with the liquid-storage container. This arrangement prevents the liquid from filling the air inlet duct when the liquid is poured using the pouring spout. It also minimizes evaporation and permeability of the liquid on internal surfaces inside the pouring spout.

11 Claims, 22 Drawing Sheets

(56) References Cited

U.S. PATENT DOCUMENTS

| | | | | |
|---|---|---|---|---|
| 6,155,464 | A | 12/2000 | Vachon | |
| 6,435,380 | B1 * | 8/2002 | Raboin | 222/484 |
| 6,722,535 | B1 | 4/2004 | Flach | |
| 6,968,875 | B2 | 11/2005 | Nielsen | |
| 7,013,936 | B2 | 3/2006 | Schliemann et al. | |
| 7,128,108 | B2 | 10/2006 | Nielsen | |
| 7,621,304 | B2 | 11/2009 | Nielsen | |
| 8,201,595 | B2 * | 6/2012 | Trippi, Jr. | 141/292 |
| 8,403,185 | B2 | 3/2013 | Vachon | |

* cited by examiner

AUTO-VENTED AUTOMATIC STOP FLOW POURING SPOUT

CROSS-REFERENCE TO PRIOR APPLICATIONS

This is a continuation of U.S. patent application Ser. No. 12/677,863 filed on 5 Jul. 2010, which is a §371 national phase entry of PCT/CA2008/001605 filed on 10 Sep. 2008 under priority of Canadian patent application No. 2,601,607 filed on 12 Sep. 2007, the contents of which are hereby incorporated by reference.

TECHNICAL FIELD

The present invention relates to an auto-vented automatic stop flow pouring spout optionally provided with a childproof protection, which can be used on various types of liquid-storage containers to pour the liquid contained in these liquid-storage containers into receiving containers or tanks, with a minimum risk of accidental spill and/or evaporation.

BACKGROUND

Pouring spouts connectable to liquid-storage containers in order to fill up receiving containers or tanks with liquids while reducing to a minimum the risks of spillage are already known. By way of example, reference can be made to Canadian Patent No. 2,381,533 issued on 10 Aug. 2004, with designation by the same inventor and to its corresponding U.S. Pat. No. 6,155,464.

SUMMARY

The present invention is an improvement to the basic structure of the pouring spout disclosed in the above-mentioned patents.

More specifically, there is provided an auto-vented automatic stop flow pouring spout connectable to a liquid-storage container in order to pour by gravity a liquid stored in the liquid-storage container, the pouring spout having a first end and a second end, the pouring spout including a first tube detachably connectable to the liquid-storage container at the first end of the pouring spout, a second tube slideably connected to the first tube, and a liquid outlet duct and an air inlet duct, both uninterruptedly extending inside the first and second tubes between the first and second ends of the pouring spout, the liquid outlet duct and the air inlet duct being both selectively opened and closed with reference to the liquid-storage container at the first end of the pouring spout by a spring-biased valve system having an open position and a closed position, the air inlet duct, when the valve system is moved from the closed position to the opened position, being initially made in fluid communication with the liquid-storage container only either simultaneously with the liquid outlet duct or immediately after the liquid outlet duct is initially made in fluid communication with the liquid-storage container, thereby preventing the liquid in the liquid-storage container from filling the air inlet duct when the liquid is poured using the pouring spout and minimizing evaporation and permeability of the liquid on internal surfaces inside the pouring spout.

In accordance with the invention, the valve system is arranged so as to cause the liquid outlet duct and the air inlet duct to open separately into the storing container. The valve system allows the liquid stored in the liquid-storage container to flow freely out of the same through the liquid outlet duct, and air to separately enter into the liquid-storage container via the air inlet duct, thereby preventing any interference.

The valve system is arranged to allow the outlet of liquid and the air entrance to close at the same time.

The valve system also provides a faster flow even if the pouring spout has a small outlet.

Moreover, the valve system permits to obtain a reduction of evaporation by reducing to a minimum the materials in contact with the liquid stored in the liquid-storage container.

In one example, the second tube is slideably mounted externally onto the first tube and the valve system includes a single piece of elongated form that is slideably mounted internally within the first tube, the piece having one end that is rigidly connected to the second tube so as to be moved with it relative to the first tube and that is divided into several longitudinal sections by means of radial walls so as to complete the liquid outlet duct and the air inlet duct of the second tube, the piece also having an opposite end shaped so as to act as a closing wall, the other end having a portion that is in registry with the air inlet duct and being of an angled hollow shape and provided with a narrow rectangular opening that permits a clear gradual opening of the air inlet duct separately from the opening of the liquid outlet duct when the piece is pushed by the second tube within the liquid-storage container in order to open it.

In another example, the second tube is slideably mounted externally onto the first tube and the valve system includes a bascule valve pivotally mounted at an extremity of a holding tube that is part of the second tube and is arranged so as to extend within the first tube and to act as part of the air inlet duct and as a support and a guide for the internal spring of the pouring spout, the holding tube passing through a holding ring that is part of the first tube and arranged so as to retain the internal spring, the bascule valve being mounted onto the holding tube by means of a support that is part of the bascule valve and is provided with a U-shaped recess which is positioned so as to be in registry with the holding tube and thus to allow and control air entrance within the liquid-storage container when the pouring spout is activated, the bascule valve in closed position extending fully across the first tube and thus preventing both air and liquid from passing into the first tube, the first tube and the bascule valve including stoppers positioned so as to guide and stop the bascule valve in closed position.

In another example, the second tube is slideably mounted internally within the first tube and includes an inlet portion which is arranged so as to act as the valve system, the inlet portion including a valve head that externally projects from the inlet portion so as to come into contact with the second tube when the pouring spout is closed, the valve head being also closed by an end wall, so as to complete the closing of the pouring spout, the inlet portion acting as the valve system also including a hole made into the second tube close to the valve head so as to give separate access to the air inlet duct integrated to the second tube and one or more other holes also made close to the valve head so as to give access to the liquid outlet duct also integrated to the second tube, the holes opening the air inlet duct and liquid outlet duct when the second tube is pushed back within the first tube.

As can be appreciated, the pouring spout according to the invention is not only very effective but is also inexpensive and of high quality.

The invention and its advantages will be better understood upon reading the following non-restrictive description of three examples thereof made with reference to the accompanying figures.

DETAILED DESCRIPTION

Figure 1A:
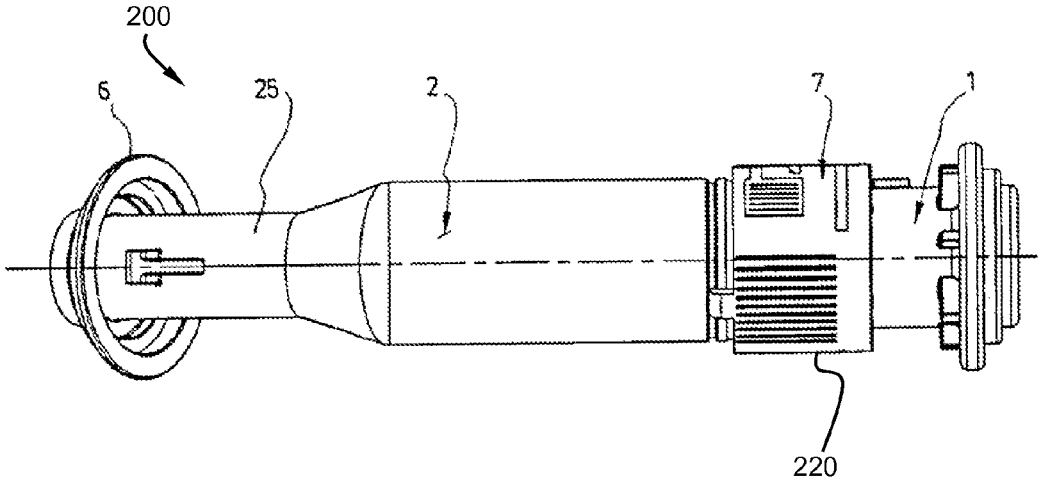
FIGS. 1A, 1B and 1C illustrate a first example of a pouring spout as suggested herein, the pouring spout being shown in a closed position.

The detailed description and appended figures present three examples the pouring spout as suggested herein. The first pouring spout example 200 is shown in FIGS. 1A to 7 and in FIGS. 23A to 23D. The second pouring spout example 300 is shown in FIGS. 8A to 14 and in FIGS. 24A to 24D. The third pouring spout example is shown in FIGS. 15A to 22 and in FIGS. 25A to 25D.

In all examples, the pouring spout includes a first end and a second end. The first end is the one that is connected to a liquid-receiving container 500, as shown for instance in FIGS. 23A to 25D. The second end is the one through which the liquid flows out of the pouring spout when liquid is poured from the liquid-storage container 500 to a receiving container or tank.

First Pouring Spout Example

As shown in FIGS. 1A to 7, the first pouring spout example 200 includes a first tube 1 to which a second tube 2 is slideably connected. The first tube 1 is arranged to connect the first end of the first pouring spout example 200 to the liquid-storage container 500.

The second tube 2 includes an outlet exit portion 25, which is itself provided with a separate internal air inlet duct 16 arranged to let air pass through it directly inside the liquid-storage container 500. The first tube 1 also includes an internal air inlet duct 28 which is arranged and positioned to be in registry and in fluid communication with the air inlet duct 16 of the outlet exit portion 25 of the second tube 2. Together, the air inlet duct 16 and the air inlet duct 28 of the first pouring spout example 200 form the air inlet duct of the pouring spout.

Figure 1B:
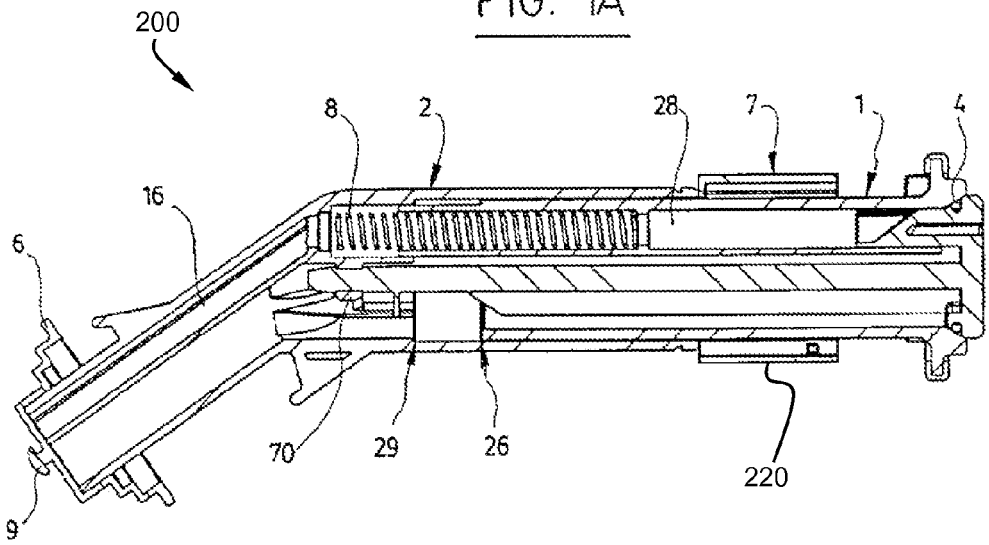

As shown in FIG. 1B, the second tube 2 receives a spring 8 acting as a closing element. The spring 8 is located in or on the air inlet duct 28 of the second tube 2. This arrangement reduces the overall dimension and cost of the first pouring spout example 200 while making its assembling easier. It also increases the available space, thereby resulting in an increased liquid flow.

Teeth 21, 22 are provided onto the second tube 2 in order to facilitate the opening of the first pouring spout example 200 when it is pressed against the neck of a receiving container or tank to be filled. These teeth 21, 22 also help to support the weight of the liquid-storage container 500 while filling the receiving container or tank.

The outlet exit portion 25 of the first pouring spout example 200 advantageously has a small diameter and may optionally extend at an angle of up to 90° (the angle being about 30° in the first pouring spout example 200) in order to facilitate its insertion into the receiving container or tank to be filled, while allowing the user to see inside this receiving container or tank. This can mitigate spillage.

Figure 4A:
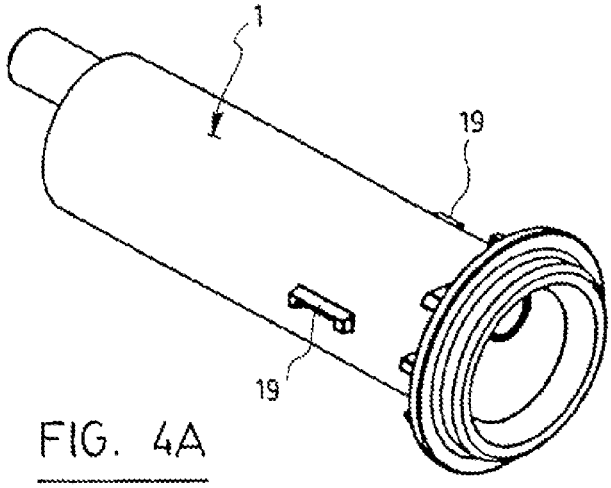
FIGS. 4A to 4C are isometric, cross-sectional and top plan views, respectively, of the first tube of the first pouring spout example.
Figure 4B:
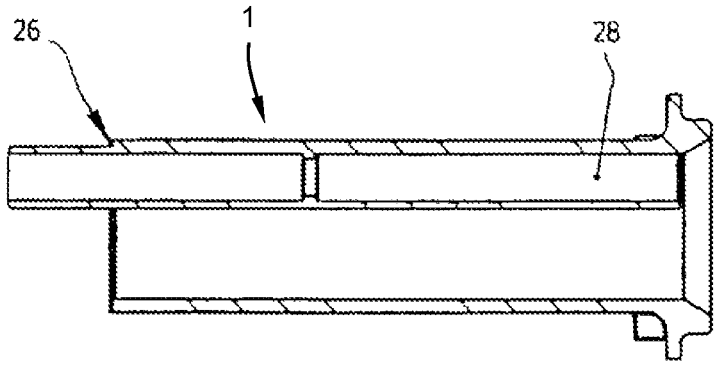
Figure 4C:
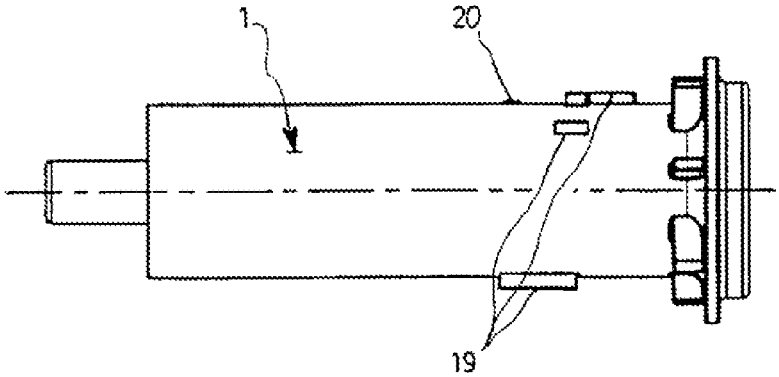

As shown in FIGS. 4A and 4C, the first tube 1 of the first pouring spout example 200 has an external surface provided with projections and/or grooves 19, 20 acting as guides, locks and/or retainers. The purpose of these projections and/or grooves 19, 20 is to allow positioning and locking a childproof security system 7, to hold back the spring of the valve system as will be explained hereinafter, and to prevent the first and second tubes 1, 2 from turning one upon the other. More specifically, the projections and/or grooves 19, 20 are also provided to prevent the second tube 2 from turning around the first tube 1.

Figure 1C:
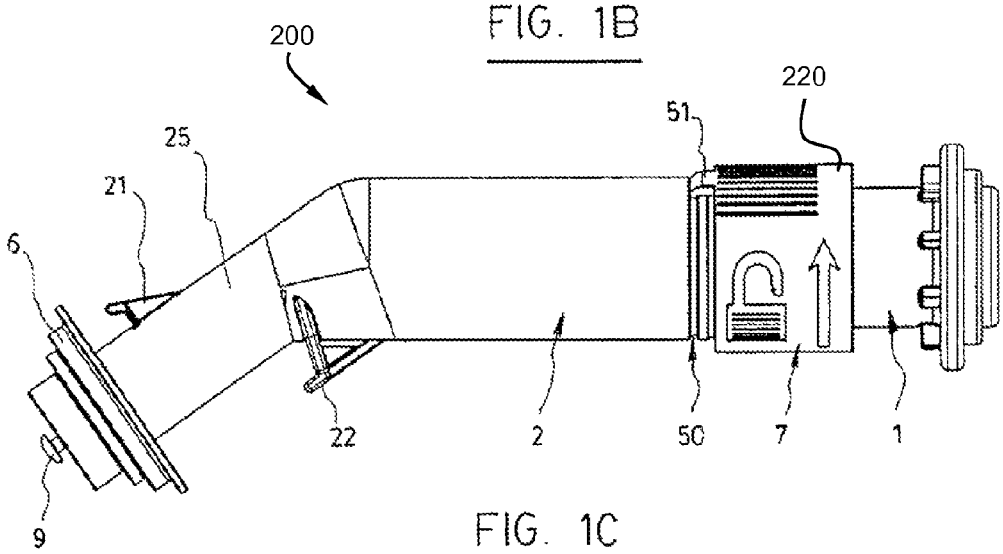

As best shown in FIG. 1C, a circumferential groove 50 is advantageously provided on the exterior surface of the end of the second tube 2 that is opposite to the outer exit portion 25, so as to hold a hook 51 that is part of the childproof security system 7.

As shown in FIG. 1B, a thin and flexible circular plastic ring 26 is positioned at the end of the portion of the first tube 1 that is inserted into the second tube 2. This ring 26 is arranged to be pressed against a stopper 29 made into the second tube 2, and thus acts as a sealing means to make the first and second tubes 1, 2 leak-proof and thus provide the first pouring spout example 200 with an automatic stop flow. The tightness between the stopper 29 and the ring 26 creates a seal between the inner and outer tubes 1, 2, thereby preventing air to be introduced between the first and second tubes 1, 2. This can otherwise cause the liquid flow to decrease or even stop.

In use, when the liquid starts to flow and reaches the outlet of a conventional pouring spout, the flow decreases and, in most of the cases, is automatically stopped. Then, the liquid-storage container 500 becomes itself under negative pressure since no air can penetrate into it when the liquid reaches the outlet unless there is an open ventilation hole in the liquid-storage container 500. The concept suggested herein alleviates this drawback.

As can be noticed, the first pouring spout example 200 has a valve system 3 at its inside end to open and close the liquid outlet duct and air inlet duct at the same time and to hold the assembled parts of the first pouring spout example 200 together. Such arrangement considerably reduces the fabrication and assembling costs. The closed position of the first pouring spout example 200 is illustrated in FIGS. 1A to 1C. The open position is illustrated in FIGS. 2A to 2C.

Figure 2A:
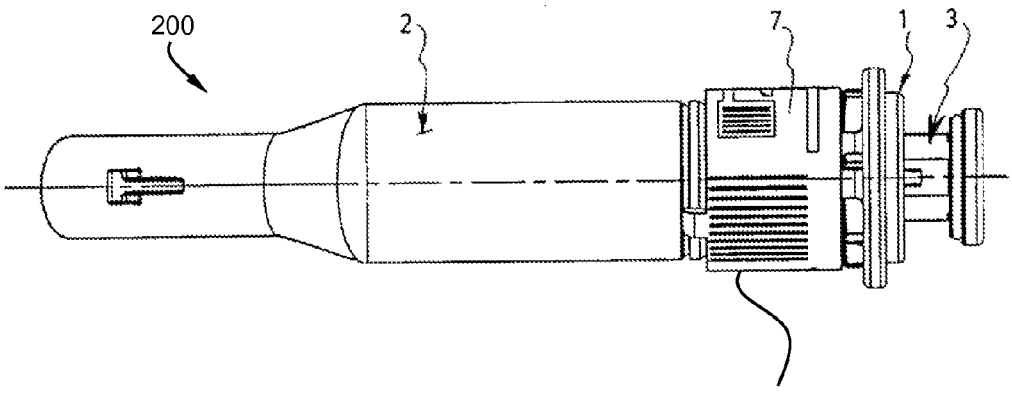
FIGS. 2A, 2B and 2C are views similar to FIGS. 1A, 1B and 1C, but with the pouring spout being shown in an open position.
Figure 2B:
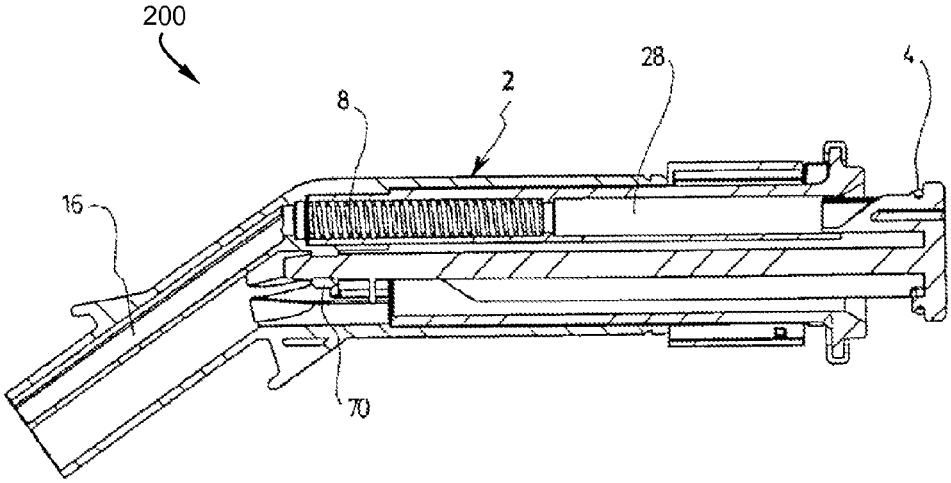
Figure 2C:
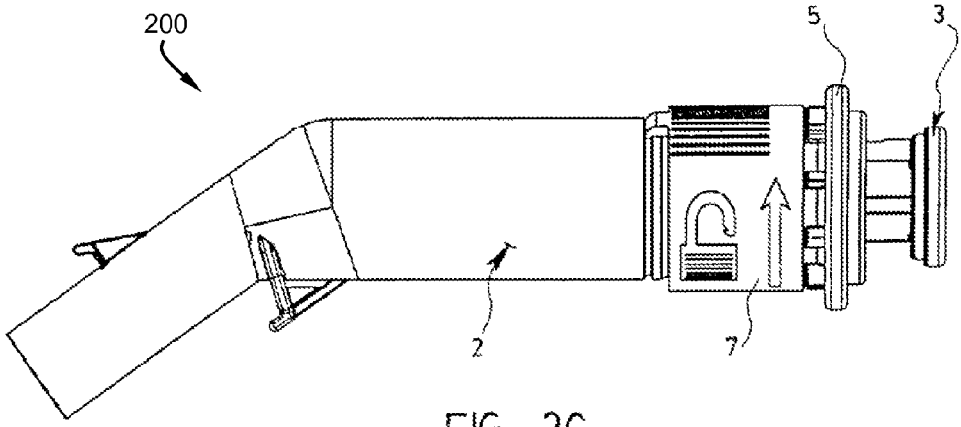

The valve system 3 includes a valve element that can be moved in and out of engagement with a corresponding seat at the first end of the first tube 1, as shown for instance in FIGS. 2A to 2C. A peripheral seal 4 can be provided around the valve element to enhance the sealing engagement between the parts, as shown in FIG. 2B.

The valve system 3 forms an opening mechanism which is controlled by the relative movement of the first and second tubes 1, 2. This opening mechanism is arranged to cause the liquid to flow more rapidly than the air may enter so that the outflow of liquid can create a negative pressure inside the liquid-storage container 500. This prevents the liquid from going into the air inlet duct and thus from considerably reducing the liquid flow and/or considerably lengthening the start of the flow.

The entrance to the air valve is placed in order to direct the incoming air inside the liquid-storage container 500 in such a manner as to prevent its interaction with the rapidly outflowing liquid. The valve system 3, which is a combined air and liquid valve, prevents the air and the liquid from conflicting with each other, and thus from reducing the liquid flow. The valve system 3 also controls the quantity of air entering the liquid-storage container 500, and thus allows a rapid and constant flow without the air having to come in through the liquid outlet and to create a jerky or irregular flow.

In use, opening of the valve system 3 creates an opening movement which extends the air inlet duct inside the liquid-storage container 500 and reduces the difference of gravity between the liquid going out and the air coming in, thus increasing the liquid flow.

Figure 5A:
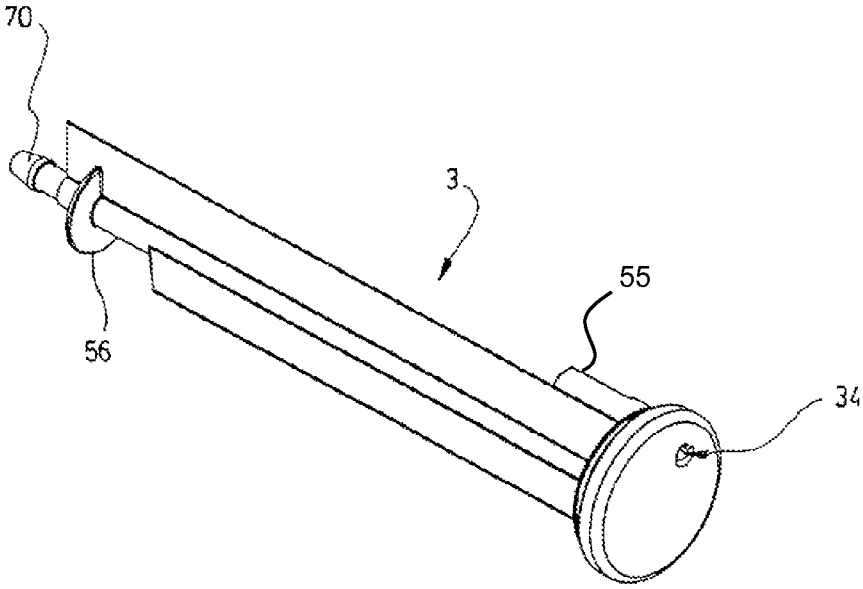
FIGS. 5A and 5B are isometric and side views, respectively, of the valve system of the first pouring spout example.
Figure 5B:
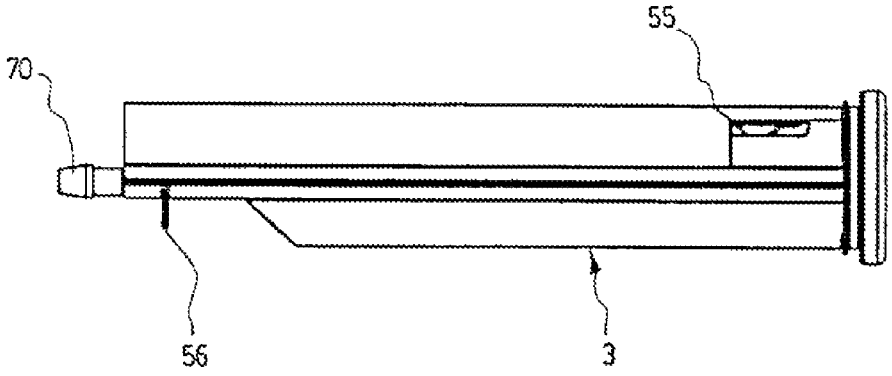
Figure 6:
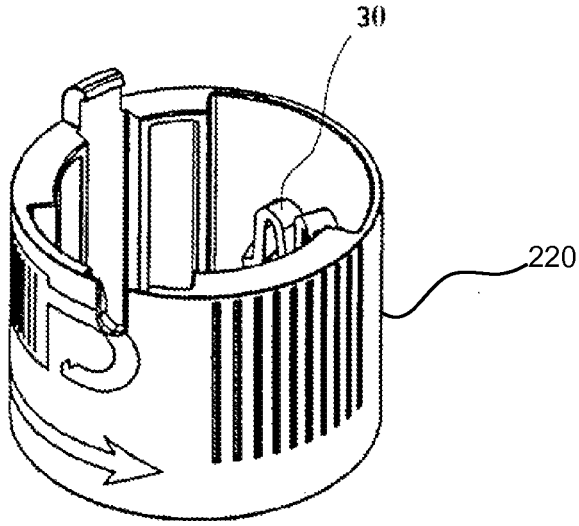
FIG. 6 is an isometric view of the knob of the childproof security system of the first pouring spout example.
Figure 7:
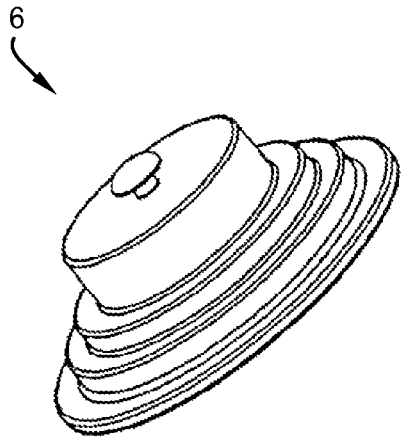
FIG. 7 is an isometric view of the cap of the first pouring spout example.

The first pouring spout example 200 includes a combined liquid and air valve 3 made of a single piece, which is of an elongated form but divided into numerous longitudinal sections by radial walls that are of uneven height. The sections formed by these walls actually complete the air inlet duct of the second tube 2 while also forming a liquid outlet duct. Advantageously, as shown in FIGS. 5A and 5B, the valve system 3 includes one or several transversal walls 56 that are positioned so as to regulate and control the liquid flow within a portion of the liquid outlet duct formed within the first tube 1.

The air inlet end 55 of the valve system 3 is shaped and positioned so as to form a closing wall. The portion of the air inlet end 55 that is in registry with the air inlet duct 28 formed within the first tube 1, is of an angular, hollow shape and is ended with a narrow channel 34 of a specific width and length selected so as to fit into the internal air inlet duct 28 of the first tube 1. In use, the air inlet end 55 provides a gradual opening of the air inlet duct 28 while opening the valve system 3. As aforesaid, the air inlet duct 28 is arranged and positioned to be in fluid communication with the air inlet duct 16 of the second tube 2 of the first pouring spout example 200.

Figure 3A:
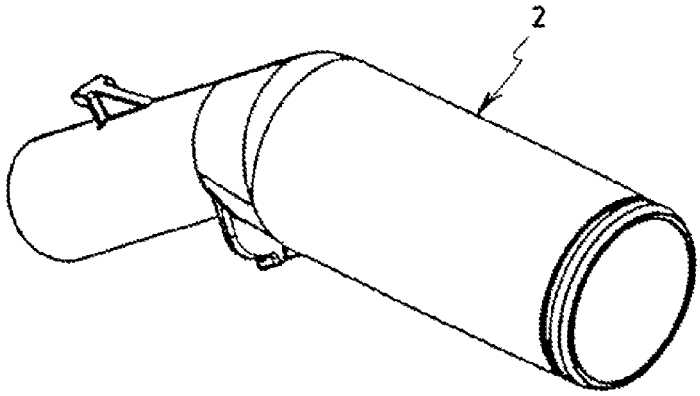
FIGS. 3A and 3B are isometric and cross-section views, respectively, of the second tube of the first pouring spout example.
Figure 3B:
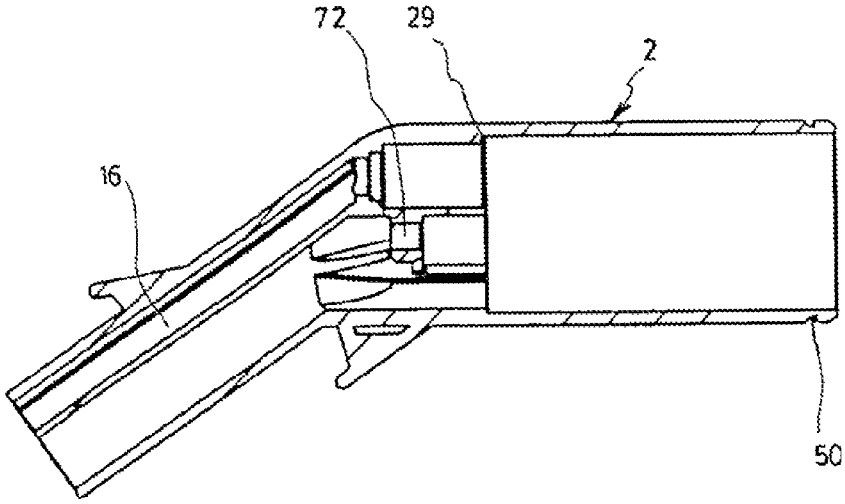

The connection between the first and second tubes 1, 2 is achieved using a locking pin 70 that projects from the front end of the valve system 3 and is designed to be introduced and held in a corresponding hole 72 provided in the middle of the second tube 2, as shown in FIG. 3B.

The childproof security system 7 of the first pouring spout example 200 includes a ring-shaped knob 220 mounted to pivot around the second tube 2 at the rear end of the same. The childproof security system 7 also includes an integrated spring 30 that is held compressed in order to ensure an automatic shut off of the first pouring spout 200 after complete or partial use, and thus lock the childproof security system 7 to prevent accidental opening, or opening by a child. The knob 220 of the childproof security system 7 must be turned in the direction shown on it with an arrow in order to open the first pouring spout example 200. It must be turned until it reaches the stopper that holds it into the opened position. Once done, the first pouring spout example 200 can now be opened. When the first pouring spout example 200 is being opened, the knob 220 of the childproof security system 7 slides against the adjacent stopper until it is no longer in contact with the stopper. This allows the knob 220 to return to its childproof security closing position when closing the first pouring spout example 200.

When the first pouring spout example 200 is opened, the childproof security system 7 is of course held in an unlocked position. Thus, the first pouring spout example 200 can be opened completely. After complete or partial opening of the first pouring spout example 200 while filling a gas motor tank, or when the user releases the force on the supports of the first pouring spout example 200, the flow stops and the childproof security system 7 is automatically closed and locked.

Figure 23A:
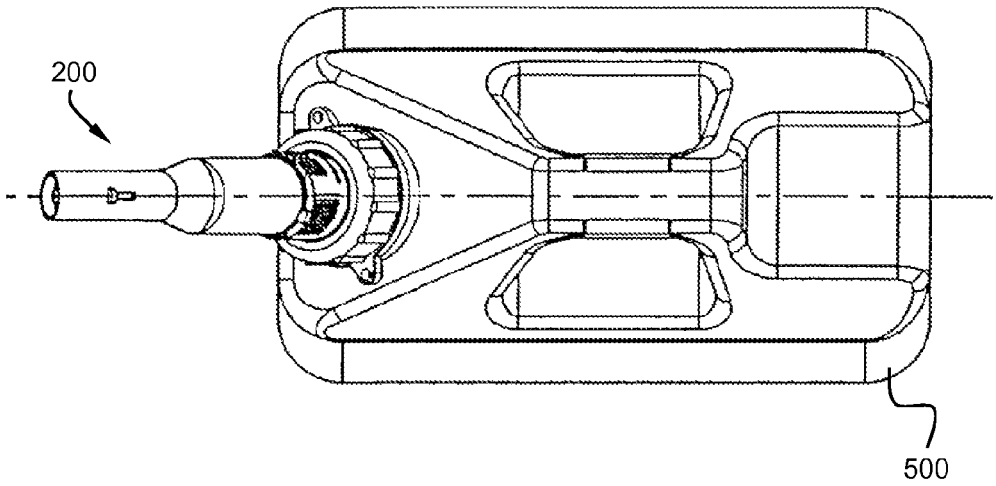
FIGS. 23A to 23D are views of the first pouring spout example when installed on a liquid-storage container.
Figure 23C:
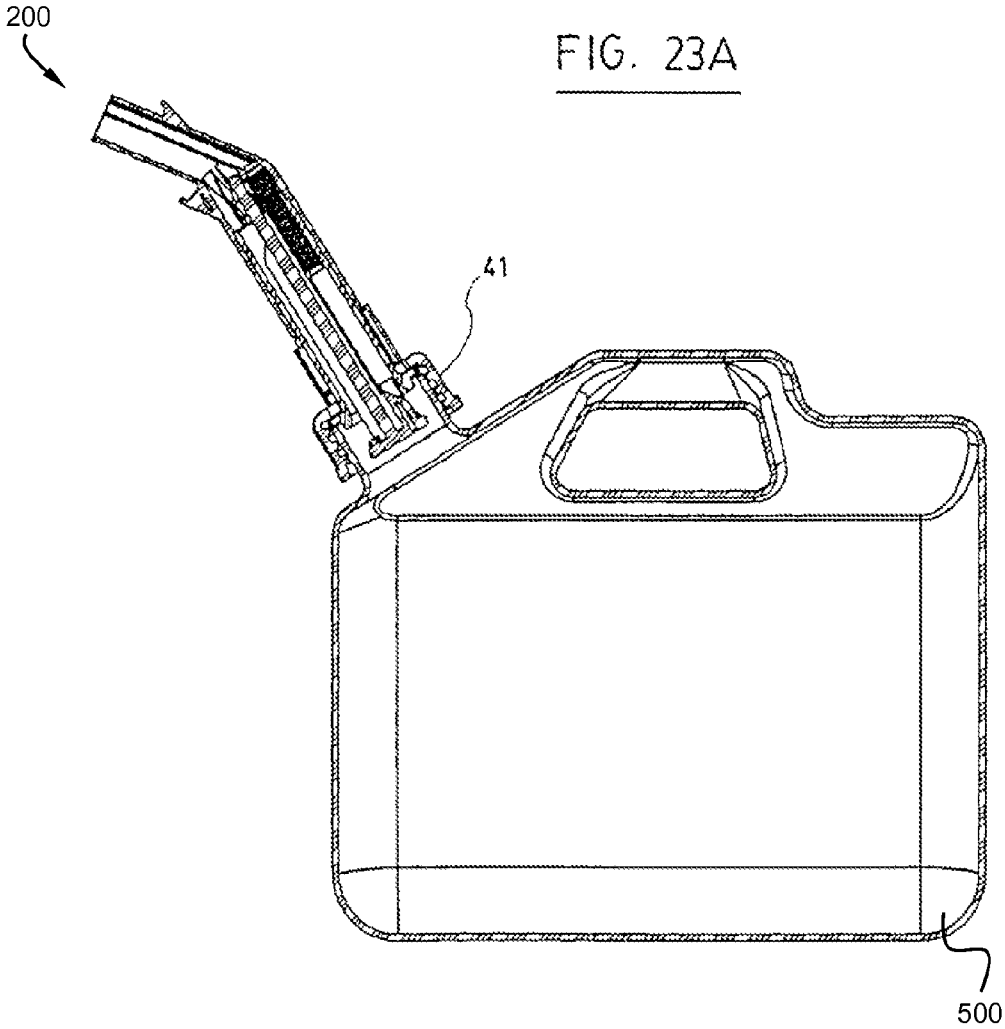
Figure 23B:
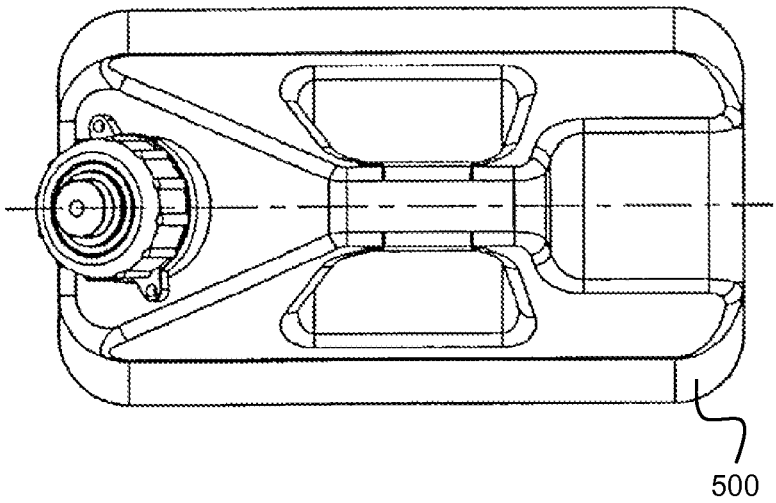
Figure 23D:
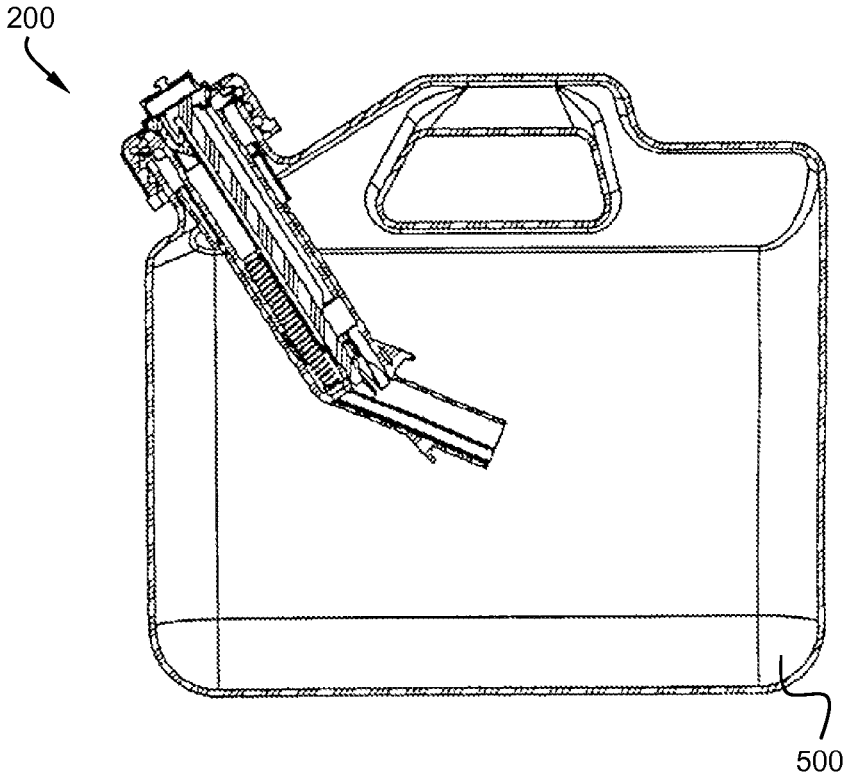

A cap 6 can be used to stop dust and dirt from falling inside the first pouring spout example 200, thereby ensuring a clean filling and better efficiency. This cap 6 is arranged to fit onto at least the outlet exit portion 25 of the second tube 2, and optionally onto the first tube 1 in order to prevent undue entry of dust or dirt. The cap 6 can also be used to close the liquid-storage container 500 during the sale process and/or for security while transporting. It is also useful to close the liquid-storage container 500 when the first pouring spout example 200 is inside the liquid-storage container 500 as is shown in FIGS. 23B and 23D. As is shown, the cap 6 may also include attachment means 9 for use to connect it to some other part of the first pouring spout example 200 such as the childproof security system 7 and thus to prevent it from being lost.

FIGS. 23A to 23D illustrate the first pouring spout example 200 installed in, on, or in a liquid-storage container 500. It is worth noting that the first pouring spout example 200 may be installed outside of the liquid-storage container 500 for filling purposes, or installed in a reverse position, inside the liquid-storage container 500 for storage.

The connection to a liquid-storage container 500 can be made in various ways such as with the help of an annular cap 41, a fixed threaded base or any other type of adaptable base with or without threading in order to answer all the needs. The cap 41 can engage the annular flange 5 (FIG. 2C) located at the first end of the pouring spout. In every case, the first pouring spout example 200 ensures liquid proofness thanks to its valve system 3.

As can also be noticed, the first pouring spout example 200 allows liquid to flow and create a vacuum inside the liquid-storage container 500 before the air inlet duct is completely filled with liquid, thus allowing a rapid flow start and preventing a jerky or irregular liquid outflow. It also has its valve system 3 directly linked to the first tube 1, so as to be activated by the user when he or she decides to use the first pouring spout example 200. It is worth noting also that in all cases, opening of the valve system 3 is gradual. When the liquid valve is partially opened, the air entrance which is mechanically linked to it, opens gradually to a maximum already adjusted and is extended inside the liquid-storage container 500 in order to reduce the differential between the air entrance and liquid outflow. Such arrangement greatly increases the liquid flow.

As aforesaid, the key feature of the present invention is the presence of a valve system 3 that opens and closes the liquid outlet and the air entrance independently from each other. This system is positioned at the entrance of the first pouring spout example 200, and is activated by the movement of the first tube 1. When activated, the valve system 3 allows:

- to separately open the liquid outlet duct and, when activated, the air inlet duct leading to the liquid-storage container 500;
- to close the liquid outlet duct and the air inlet duct at the same time;
- to obtain a rapid flow even when the first pouring spout example 200 has a smaller outlet, thereby making the first pouring spout example 200 usable to fill-up a car and/or a small receiving container or tank;
- to obtain a reduction of the surfaces exposed to evaporation and permeability and thus a reduction to a minimum of the contact with adjacent products, thereby meeting the strictest environmental norms; and
- to direct the air flow in a direction opposite to the liquid entrance, thereby facilitating the air entrance into the liquid-storage container 500 while preventing a mixture between the air and liquid which would affect the speed of the liquid flow.

It is also worth noting that in some cases, the air valve portion of the valve system 3 does not open until the liquid valve portion of the valve system 3 is open 20 to 30%, thereby allowing a negative pressure to be built up inside the liquid-storage container 500. Such a negative pressure is needed to achieve efficient functioning of the auto-vented automatic stop flow pouring spout on a liquid-storage container 500 without vent. The delayed opening of the air inlet duct prevents the liquid from entering the air inlet duct and accelerates the start of liquid flow while preventing it from being slow and jerky. Such arrangement also ensures a controlled and increasing flow depending on the opening of the liquid valve portion for a faster start and a more regular flow. While opening the first pouring spout example 200, the air inlet duct that extends inside the liquid-storage container 500, considerably increases the flow of liquid.

The fact that the spring 8 is near or inside the air inlet duct is also an interesting feature of the invention inasmuch as it reduces the cost of the spring 8 and increases the space available for the liquid flow.

With the first pouring spout example 200, the assembly is easy and simplified. This reduces the time and cost for its assembly. Moreover, the fact that the outlet exit portion 25 extends at an angle allows visual control inside the receiving container or tank being filled.

Thanks to the teeth 21, 22 that permit to hang the liquid-storage container 500 onto the receiving container or tank to be filled up, the first pouring spout example 200 permits, just after having deactivated the childproof security system 7, to open the valve system 3 in a hands free manner. The teeth 21, 22 also hold most of the liquid-storage container's weight when in use.

As aforesaid, the first pouring spout example 200 can be made childproof and secure due to its mechanism which disengages manually and engages automatically after a partial or complete opening of the first pouring spout example 200.

As is disclosed hereinabove, an important feature of the invention lies in that the liquid outlet duct, air inlet duct and valve system are integrated to the second tube 2 slideably connected to the first tube 1 that is arranged to be connected to the liquid-storage container 500. The second tube 2 is of course provided with an outlet exit portion 25 through which air may enter into the air inlet duct and the liquid may exit through the liquid outlet duct. The first and second tubes 1, 2 are kept by the internal spring 8 in such a position with respect to each other as to keep the valve system 3 closed unless a force is applied to the second tube 2.

As is also disclosed hereinabove, the first pouring spout example 200 according to the invention is advantageously equipped with a stopper on the first tube 1 and a small circular plastic ring 26 which renders the pouring spout spill-proof when it is fully open.

Second Pouring Spout Example

The second pouring spout example 300 is shown in FIGS. 8A to 14 and in FIGS. 24A to 24D. The second pouring spout 300 includes many of the features of the first pouring spout 200.

The second pouring spout example 300 includes a first tube 10 to which a second tube 11 is slideably connected. The first tube 10 is arranged for use to connect the first end of the second pouring spout example 300 to a liquid-storage container 500.

The second tube 11 includes an outlet exit portion 27, which is itself provided with a separate internal air inlet duct 17, arranged to let air pass through it directly inside the liquid-storage container 500 to which the second pouring spout example 300 is connected. The second tube 11 receives a spring 18 acting as a closing element. Teeth 23, 24 are provided onto the second tube 11 in order to facilitate the opening of the second pouring spout example 300 when it is pressed against the neck of a receiving container or tank to be filled. These teeth 23, 24 also help to support the weight of the liquid-storage container 500 to which the second pouring spout example 300 is connected while filling the receiving container or tank. The outlet exit portion 27 of the second pouring spout example 300 advantageously has a small diameter and may optionally extend at an angle of 90° (about 30° in the second pouring spout example 300) in order to facilitate its insertion into the receiving container or tank to be filled, while allowing the user to see inside this receiving container or tank. This mitigates spillage.

The first tube 10 of the second pouring spout example 300 has an external surface provided with projections and/or grooves 19, 20, acting as guides, locks and/or retainers. The purpose of these projections and/or grooves 19, 20 is to allow positioning and locking a childproof security system 37, to hold back the spring 18 of the valve system as will be explained hereinafter, and to prevent the first and second tubes 10, 11 from turning one upon the other. More specifically, and as is illustrated, the projections or grooves are provided to prevent the second tube 11 to turn around the first tube 10.

The spring 18 is located in or on the air inlet duct of the second tube 11. This reduces its dimension and cost while making the assembly of the second pouring spout example 300 easier. Such arrangement also increases the available space, thereby resulting in an increased liquid flow.

At the end of the portion of the first tube 10 that is inserted into the second tube 11, a thin and flexible circular plastic ring 26 is positioned. This ring 26 is arranged to be pressed against a stopper 29 made into the second tube 11, and thus act as a sealing means, to make the first and second tubes 10, 11 leak-proof and thus provide the pouring spout with an automatic stop flow. In fact, when the liquid reaches the end of the spout, the flow decreases and, in most of the cases, is automatically stopped.

Then, the liquid-storage container 500 to which the second pouring spout example 300 is connected becomes itself under negative pressure since no air can penetrate into it when the liquid reaches the end of the second tube 11, unless there is an open ventilation hole in the liquid-storage container 500.

The second pouring spout example 300 includes a valve system acting as both a liquid valve and an air valve to provide the second pouring spout example 300 with a controlled and increasing flow. The valve system forms an opening mechanism which is controlled by the movement of the first and second tubes 10, 11. This opening mechanism is arranged to cause the liquid to flow more rapidly than the air may enter so that the outflow of liquid can create a negative pressure inside the liquid-storage container 500. This prevents the liquid from going into the air inlet duct and thus from considerably reducing the liquid flow and/or considerably lengthening the start of the flow.

The entrance to the air valve is placed in order to direct the incoming air inside the liquid-storage container 500 to which the second pouring spout example 300 is connected, in such a manner as to prevent its interaction with the rapidly outflowing liquid. The valve system also controls the quantity of air entering the liquid-storage container 500 and thus allows a rapid and constant flow without the air having to come in through the liquid outlet and to create a jerky or irregular flow.

In use, opening of the valve system creates an opening movement which extends the air inlet duct inside the liquid-storage container 500 and reduces the difference of gravity between the liquid going out and the air coming in, thus increasing the liquid flow.

Figure 8A:
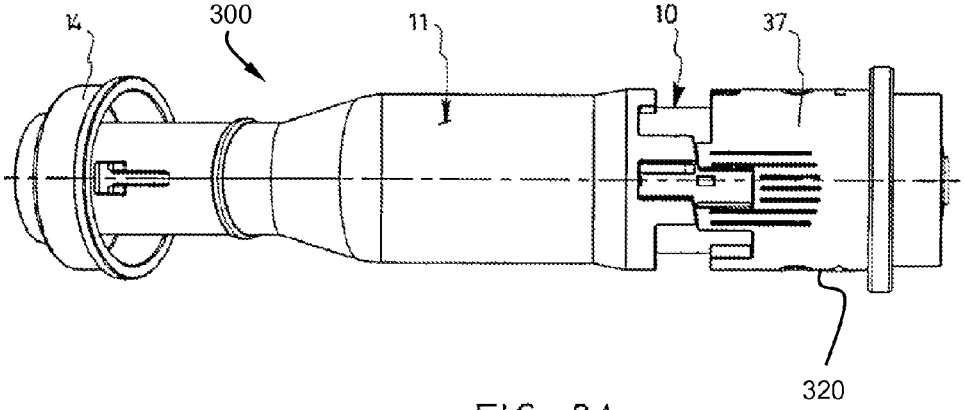
FIGS. 8A, 8B and 8C illustrate a second example of a pouring spout as suggested herein, the pouring spout being shown in a closed position.
Figure 8B:
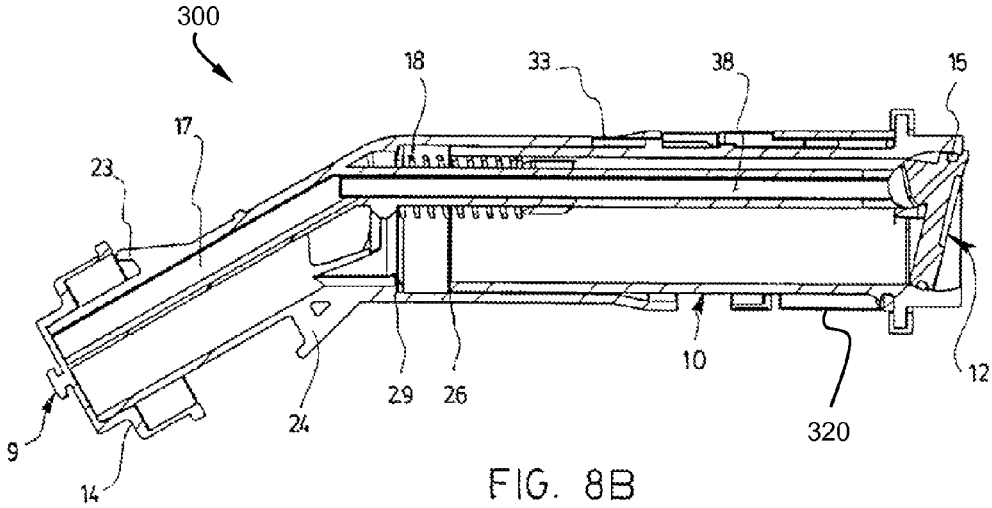
Figure 9A:
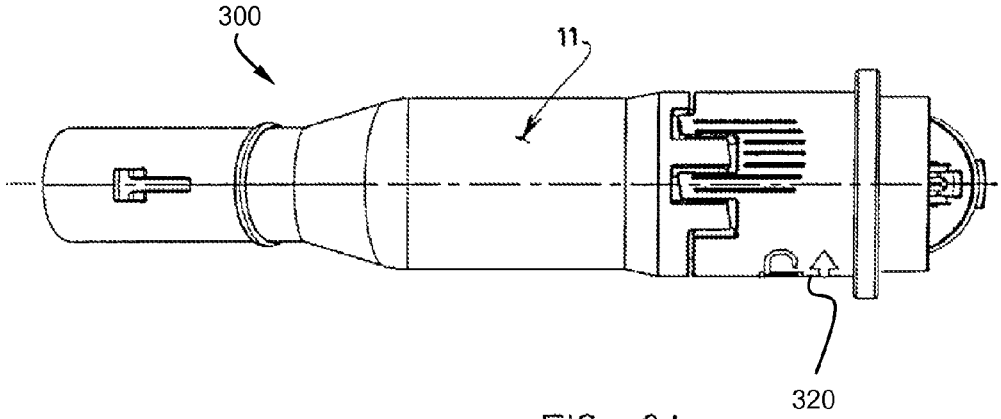
FIGS. 9A, 9B and 9C are views similar to FIGS. 8A, 8B and 8C, but with the pouring spout being shown in an open position.
Figure 9B:
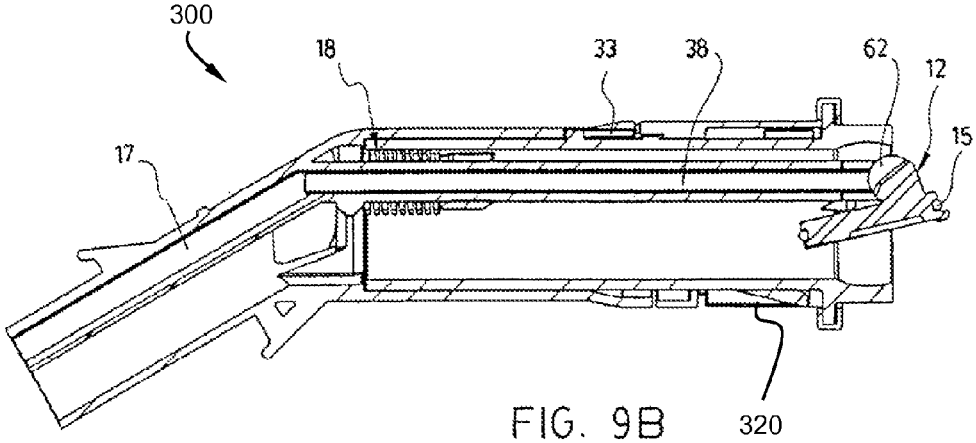
Figure 9C:
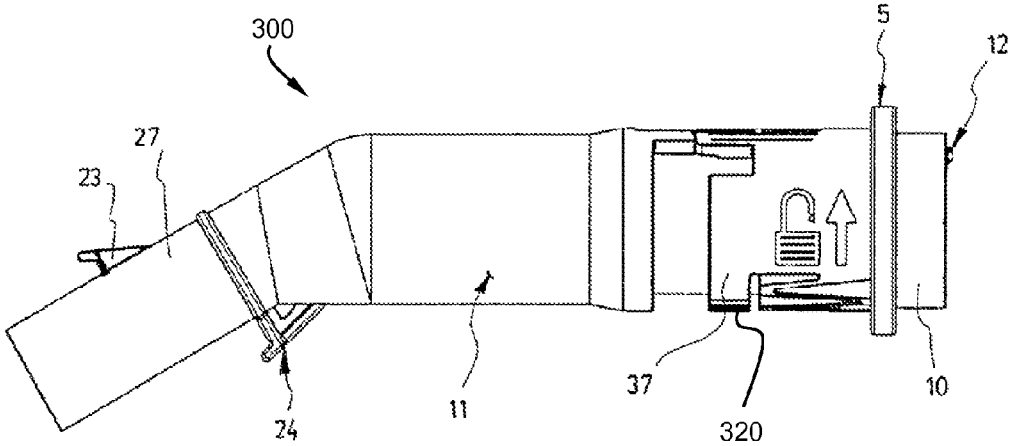
Figure 10A:
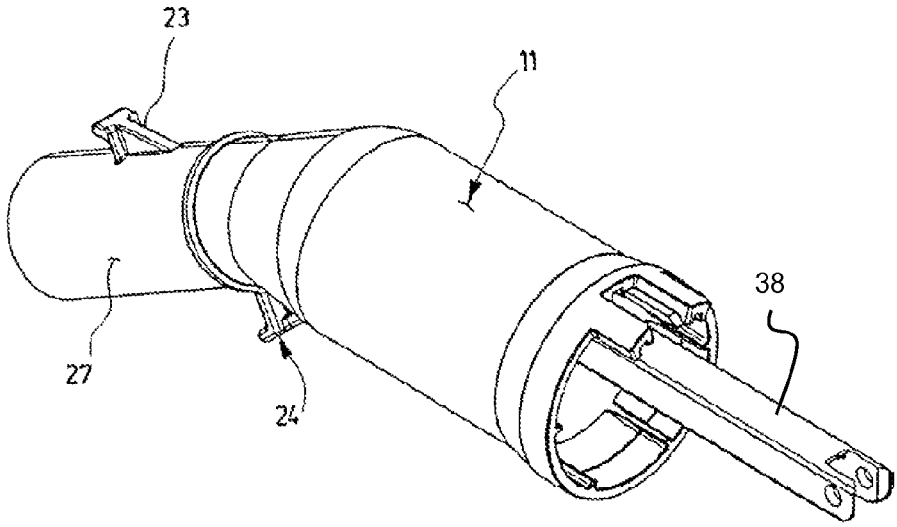
FIGS. 10A and 10B are isometric and cross-sectional views, respectively, of the second tube of the second pouring spout example.
Figure 10B:
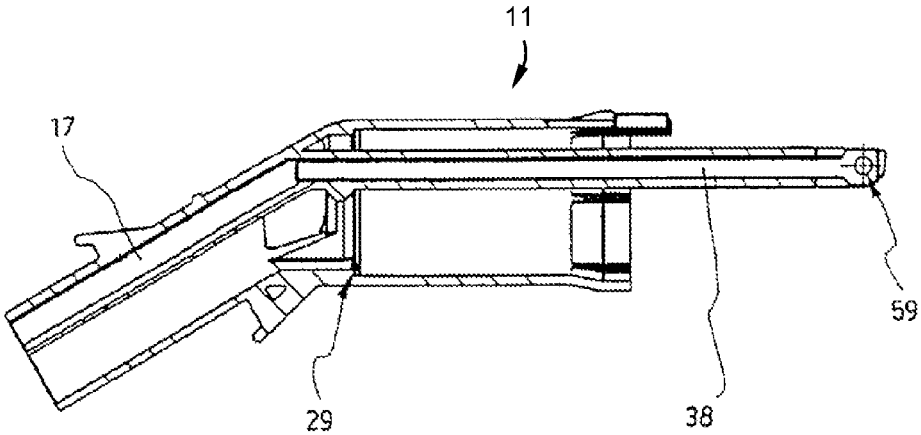
Figure 12:
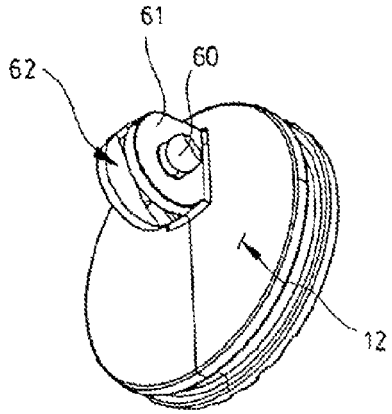
FIG. 12 is an isometric view of the bascule valve of the second pouring spout example.
Figure 14:
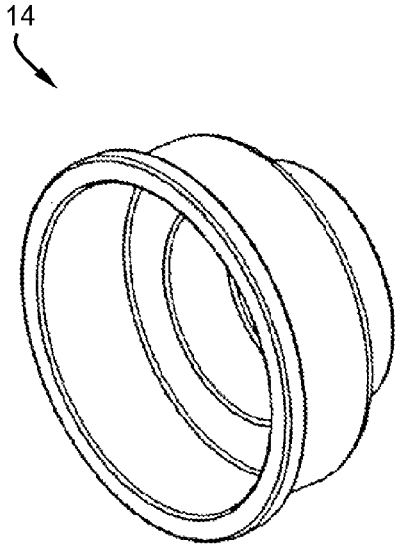
FIG. 14 is an isometric view of the cap of the second pouring spout example.
Figure 13:
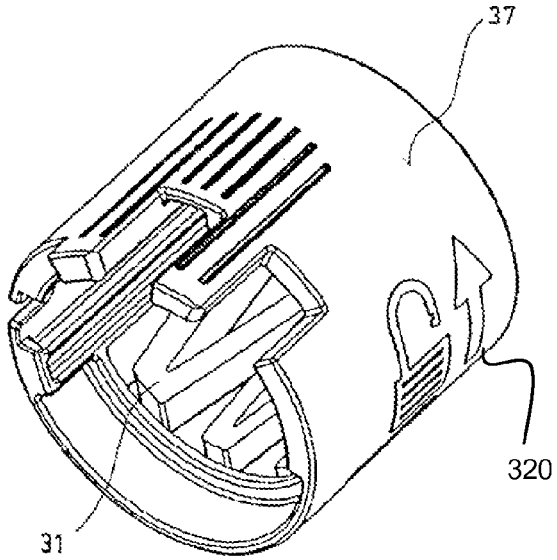
FIG. 13 is an isometric view of the knob of the childproof security system of the second pouring spout example.

In the second pouring spout example 300, and as best shown in FIGS. 9A, 9B and 12, the valve system includes a bascule valve 12 pivotally mounted at an extremity 59 of a tube 38 which forms an integral part of the outlet exit portion 27 of the second tube 11 and is positioned so as to act as a prolongation of the air inlet duct 17 of the outlet exit portion 27 of the second tube 11 (see FIG. 10), and as a support and a guide for the spring 18 (see FIG. 8B).

Figure 11A:
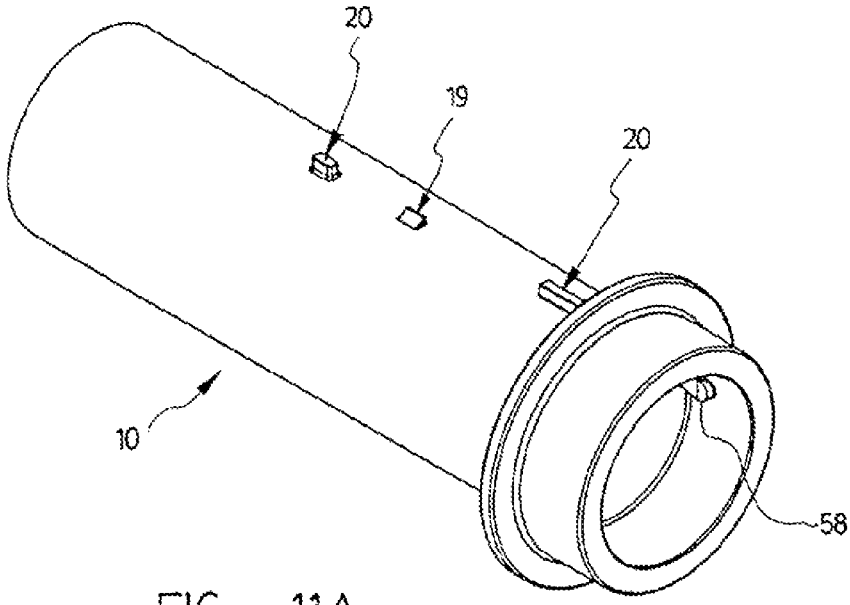
FIGS. 11A and 11B are isometric and cross-sectional views, respectively, of the first tube of the second pouring spout example.
Figure 11B:
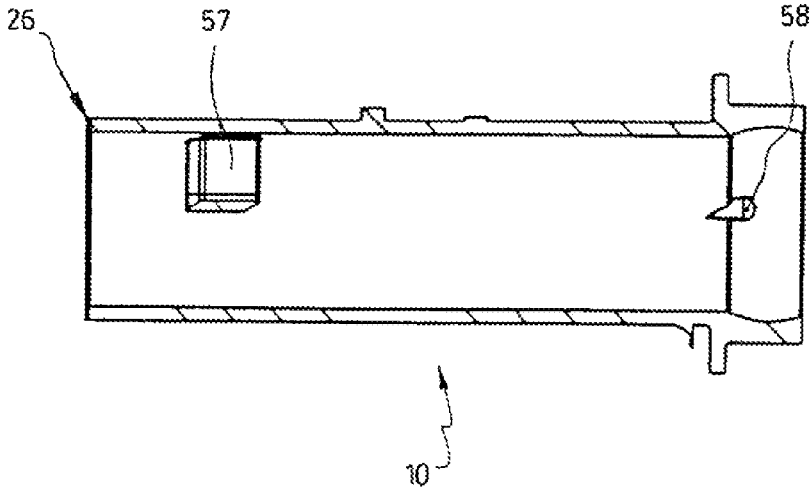

A stopper is provided onto the bascule valve 12 to stop it at proper angle and thus allow the second pouring spout example 300 to be always correctly closed in the same position. As shown in FIG. 11, stoppers 58 are also provided inside the first tube 10 to guide the bascule valve 12 to reach its close off position without restriction.

As shown in FIG. 11, a holding ring 57 is provided inside the first tube 10 to receive the tube 38 and retain the spring 18 which is mounted on it.

As aforesaid, the bascule valve 12 is pivotally connected to the extremity 59 of the tube 38. To do so, this extremity 59 is provided with opposite holes in which may be inserted pins 60 projecting from a support 61 forming part of the bascule valve 12. The pins 60 advantageously have ends extending at an angle so as to facilitate their insertion into the holes at the extremity 59 of the tube 38. This substantially facilitates the assembly of the second tube 11, the first tube 10 and the bascule valve 12.

As best shown in FIG. 12B, the support 61 is provided with a U-shaped recess 62 positioned so as to be in registry with the holding tube and thus to allow and control air entrance within the liquid-storage container 500 when the second pouring spout example 300 is activated.

As is also shown in FIGS. 8B and 9B, the bascule valve 12 is provided with a peripheral seal 15 that comes into contact with the first tube 10 and thus makes it spill-proof.

In the second pouring spout example 300, the childproof security system 37 includes a ring-shaped knob 320 mounted to pivot around the second tube 11 at the rear end of the same. It includes an integrated spring 31 that is held compressed in order to ensure an automatic shut off of the second pouring spout 300 after complete or partial use, and thus so as to lock the security childproof security system 37 to prevent accidental opening, or opening by a child. The knob 320 of the childproof security system 37 must be turned in the direction shown on it with an arrow in order to open the second pouring spout example 300. It is turned until it reaches the stopper that holds it into an open position.

Spaced-apart fingers 33 are provided on both the knob 320 and the second tube 11. The position of these fingers 33 must match to allow the second tube 11 to be pulled back.

The second pouring spout example 300 may now be opened. When being opened, the childproof security system 37 slides against the adjacent stopper until it is no longer in contact with the stopper. This allows the system to return to its childproof security closing position when closing the second pouring spout example 300.

When the second pouring spout example 300 is being opened, the childproof security system 37 is of course held in an unlocked position. Thus, the second pouring spout example 300 can be opened completely. After complete or partial opening of the second pouring spout example 300 while filling a gas motor tank, or when the user releases the force on the supports of the second pouring spout example, the flow stops and the childproof security system 37 is automatically closed and locked.

Figure 8C:
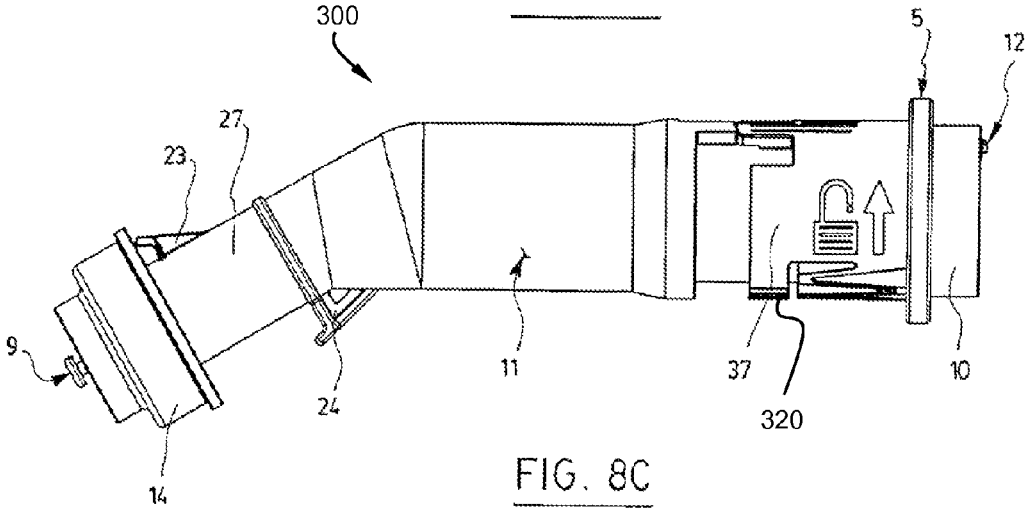
Figure 24A:
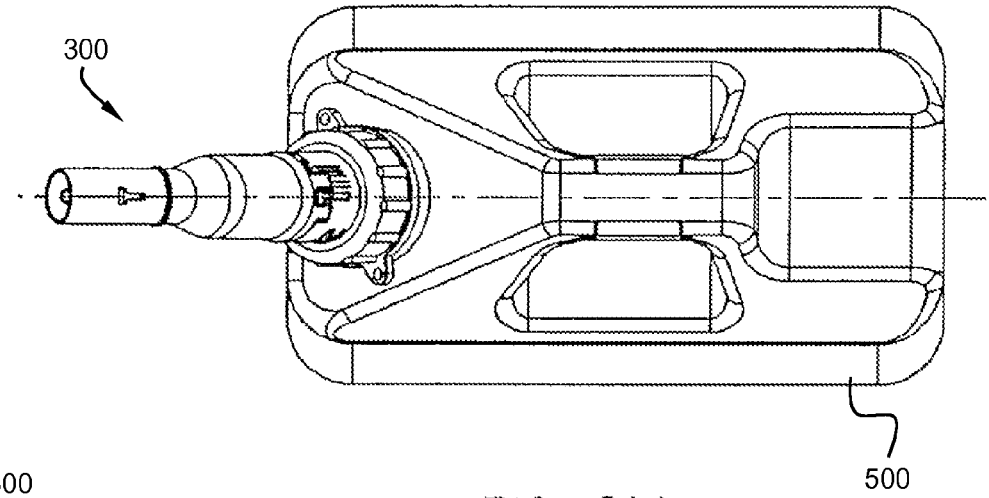
FIGS. 24A to 24D are views of the second pouring spout example when installed on a liquid-storage container.
Figure 24C:
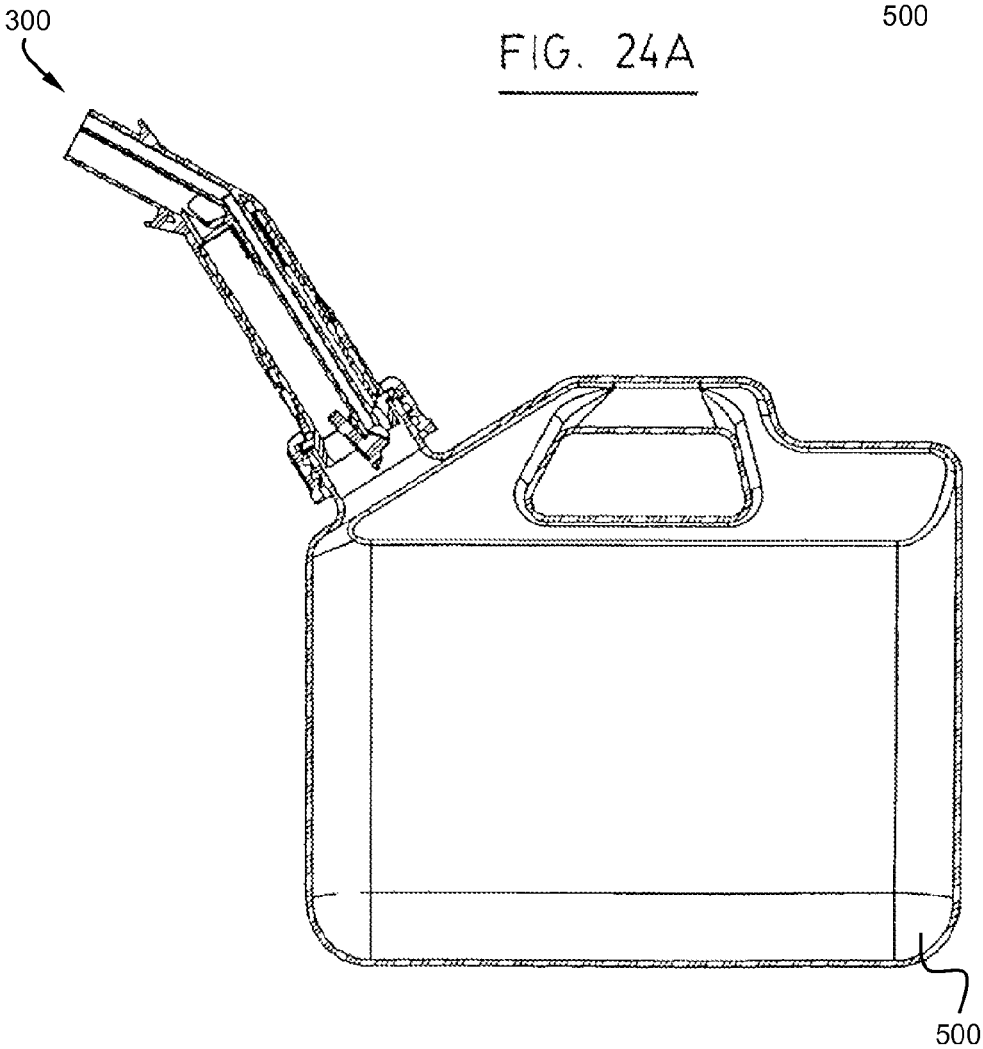
Figure 24B:
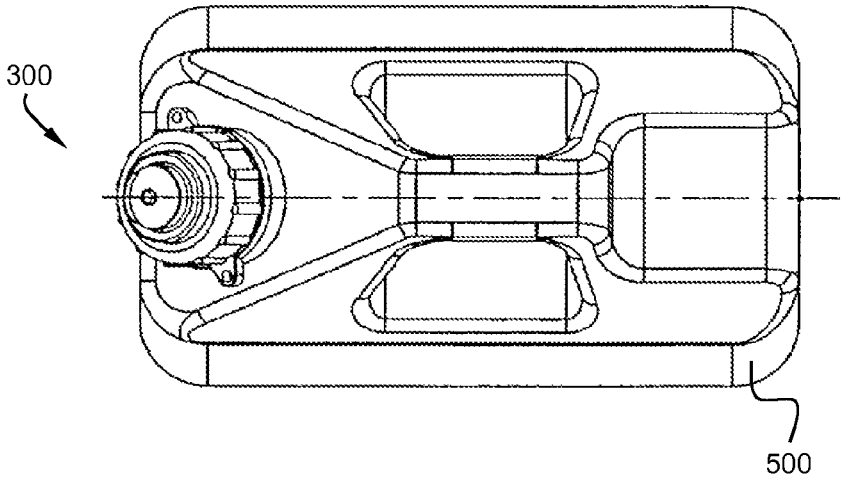
Figure 24D:
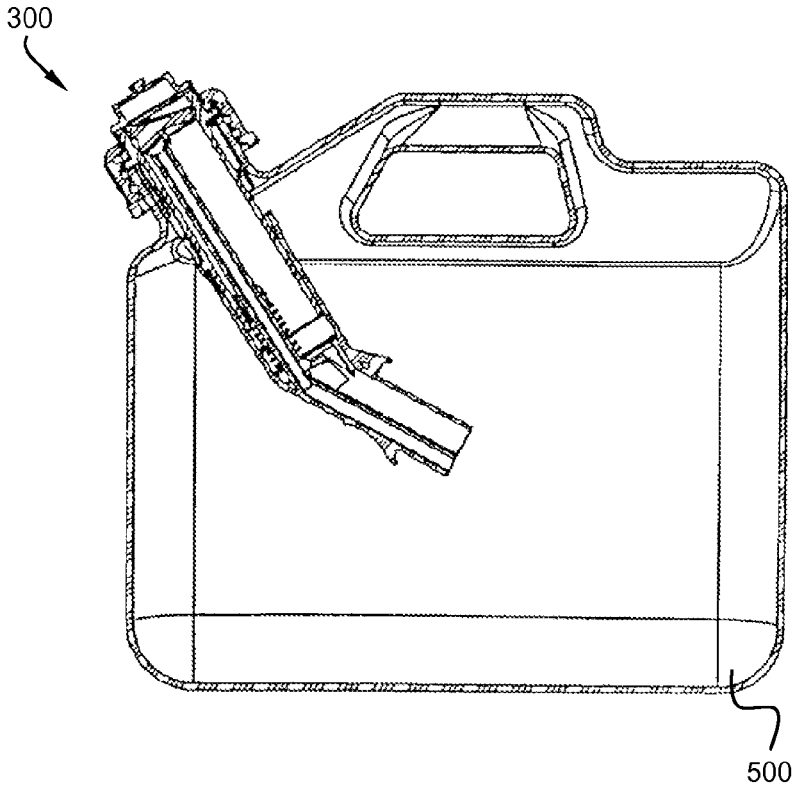

As shown in FIGS. 8A to 8C, a cap 14 can be used to stop dust and dirt from falling inside the second pouring spout example 300, thereby ensuring a clean filling and better efficiency. This cap 14 is arranged to fit onto at least the outlet exit portion of the second tube 11 and optionally onto the first tube 10 in order to prevent undue entry of dust or dirt. The cap 14 can also be used to close the liquid-storage container 500 during the sale process and/or for security while transporting. In use, the cap 14 prevents dust and dirt from going into the second pouring spout example 300. It is also useful to close the liquid-storage container 500 when the second pouring spout example 300 is inside the liquid-storage container 500 as is shown in FIGS. 24B and 24D. As is shown, the cap 14 may also include attachment means 9 for use to connect it to some other part of the second pouring spout example 300 such as the childproof security system 37 and thus to prevent it from being lost.

FIGS. 24A to 24D illustrate the second pouring spout example 300 described hereinabove, installed in, on, or in a liquid-storage container 500. It is worth noting that the second pouring spout example 300 may be installed outside of the liquid-storage container 500 for filling purposes, or installed in a reverse position, inside the liquid-storage container 500 for storage.

The connection to a liquid-storage container 500 can be made in various ways such as with the help of an annular cap 41, a fixed threaded base or any other type of adaptable base with or without threading in order to answer all the needs. The cap 41 can engage the annular flange 5 (FIG. 9C) located at the first end of the pouring spout. In every case, the second pouring spout example 300 ensures liquid proolhess thanks to its valve system.

As can also be noticed, the second pouring spout example 300 provide the same advantages as with the first pouring spout example 200.

Third Pouring Spout Example

The third pouring spout example 400 includes a first tube 91 to which the second tube 93 is slideably connected. The first tube 91 of the third pouring spout example 400 can be connected to the liquid-storage container 500.

The second tube 93 includes an outlet exit portion 94, which is itself provided with a separate internal air inlet duct 105, arranged to let air pass through it directly inside the liquid-storage container 500 to which the third pouring spout example 400 is connected. A spring 96, acting as a closing element, is provided between the first tube 91 and the second tube 93.

A tooth 92 is provided onto the second tube 93 in order to facilitate the opening of the third pouring spout example 400 when it is pressed against the neck of receiving container or tank to be filled. The tooth 92 also helps to support the weight of the liquid-storage container 500 while filling the receiving container or tank. The outlet exit portion 94 of the third pouring spout example 400 advantageously has a small diameter and may optionally extend at an angle of 90° in order to facilitate its insertion into the receiving container or tank to be filled, while allowing the user to see inside this receiving container or tank.

The third pouring spout example 400 is also a leak-proof unless there is an open ventilation hole in the liquid-storage container 500.

The third pouring spout example 400 also includes a valve system acting as both a liquid valve and an air valve to provide the pouring spout with a controlled and increasing flow. The valve system forms an opening mechanism which is controlled by the movement of the first and second tubes 91, 93. This opening mechanism is arranged to cause the liquid to flow more rapidly than the air may enter so that the outflow of liquid can create a negative pressure inside the liquid-storage container 500. This prevents the liquid from going into the air inlet duct and thus from considerably reducing the liquid flow and/or considerably lengthening the start of the flow.

The entrance to the air valve is placed in order to direct the incoming air inside the liquid-storage container 500 to which the third pouring spout example 400 is connected, in such a manner as to prevent its interaction with the rapidly outflowing liquid. The valve system prevents the air and the liquid from conflicting with each other, and thus from reducing the liquid flow. The valve system also controls the quantity of air entering the liquid-storage container 500 and thus allows a rapid and constant flow without the air having to come in through the liquid outlet and to create a jerky or irregular flow.

In use, opening of the valve system creates an opening movement which extends the air inlet duct inside the liquid-storage container 500 and reduces the difference of gravity between the liquid going out and the air coming in, thus increasing the liquid flow.

In the third pouring spout example 400, the valve system includes a valve head 108 that is integral to the inlet portion of the second tube 93 and externally projects from the same so as to come into contact with the front edge of the second tube 93 when the third pouring spout example 400 is closed. This valve head 108 is itself closed by an end wall 99 that may be integral to or welded to it. Peripheral seals 100, 101 are provided.

The valve system also includes a hole 106 made into the second tube 93 close to the valve head 108, so as to give access to the air inlet duct 105 made in the second tube 93. Other holes 107 are also provided in the second tube 93 close to the valve head 108, so as to give access to the liquid outlet duct made in the second tube 93. Opening of the holes 106, 107 is achieved when the second tube 93 is pushed back within the first tube 91 (see FIGS. 15B and 16B).

The childproof security system 98 of the third pouring spout example 400 includes a C-shaped flexible part 112 which is snapped onto a recess 110, and can be unlocked on a notch 90, provided on an assembling ring 102. Other security systems could be used if need be, especially when the third pouring spout example 400 is designed for an industrial use.

In the locked position, the flexible part 112 is positioned between fixed guides 109 forming part of the ring 102 and the stoppers 103 projecting from the first tube 91. By applied force on the flexible part 112, a lock 111, 113 is removed and allows the stopper to pass over the flexible part 112. This allows disengagement and thus partial or full opening of the third pouring spout example 400 by removing the force on the notch 90. Of course, the spring which is then loaded, will close and lock the spout again as soon as no more force is applied to it.

In the third pouring spout example 400, the assembly between the first tube 91 and the second tube 93 is made by expanded parts that lock into grooves and hold the ring that retains the spring. This also simplifies the assembly and thus allows the cost and time of assembly to be reduced.

Figure 15A:
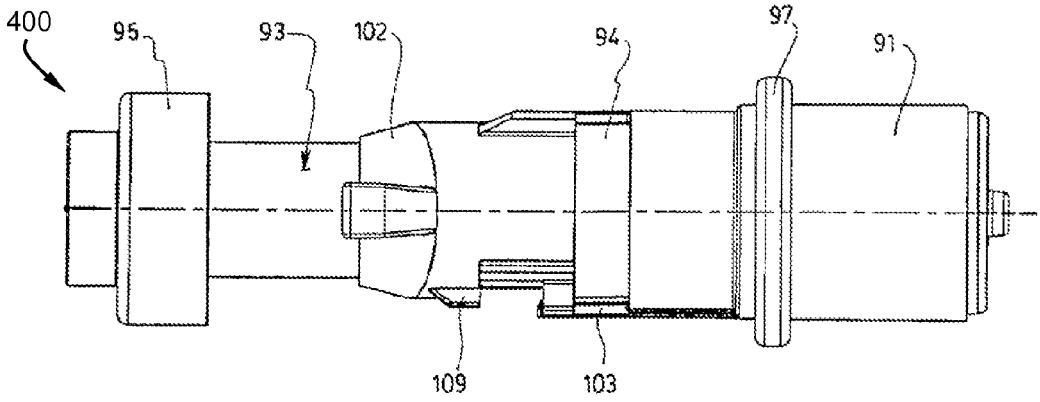
FIGS. 15A, 15B and 15C illustrate a third example of a pouring spout as suggested herein, the pouring spout being shown in a closed position.
Figure 15B:
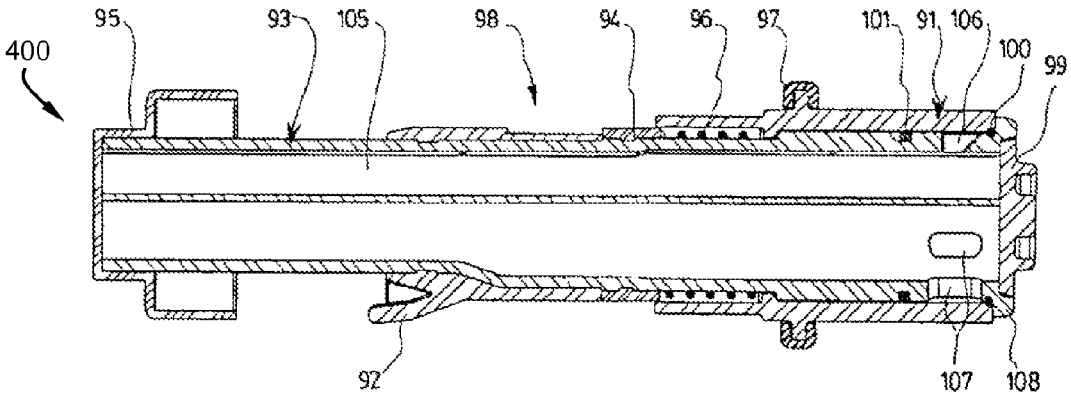
Figure 15C:
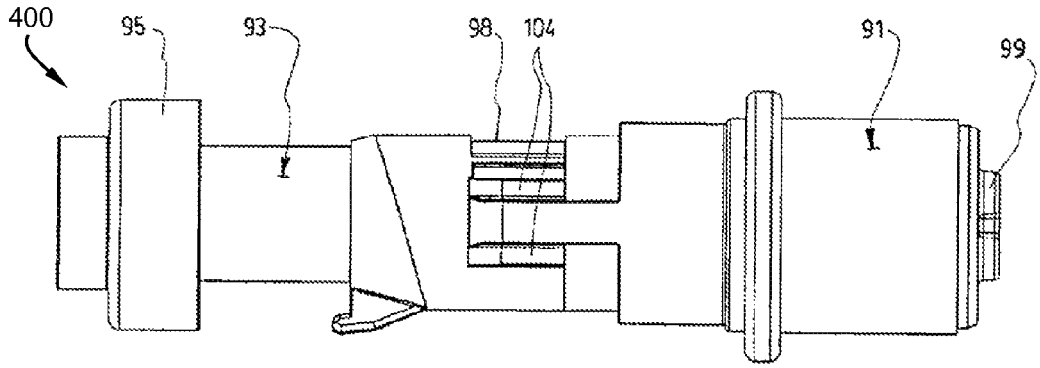
Figure 16A:
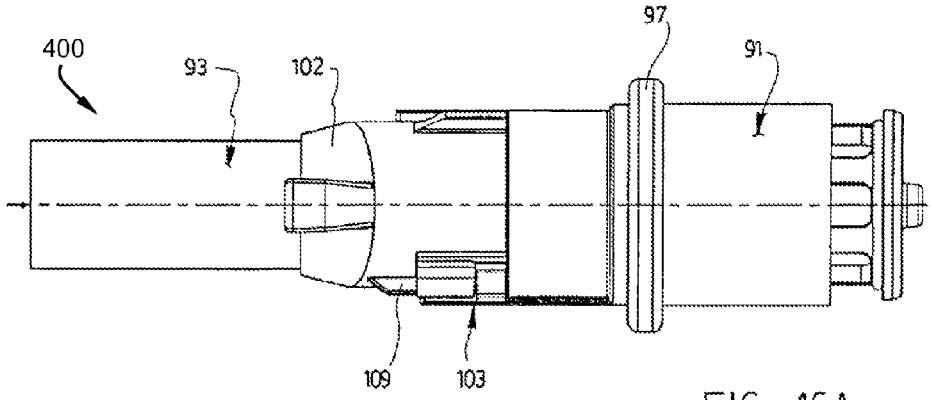
FIGS. 16A, 16B and 16C are views similar to those of FIGS. 15A, 15B and 15C, but with the pouring spout being shown in an open position.
Figure 16B:
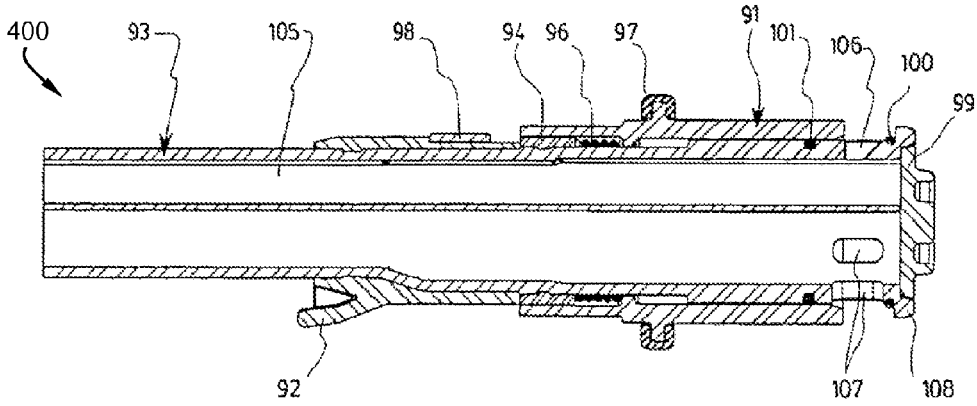
Figure 16C:
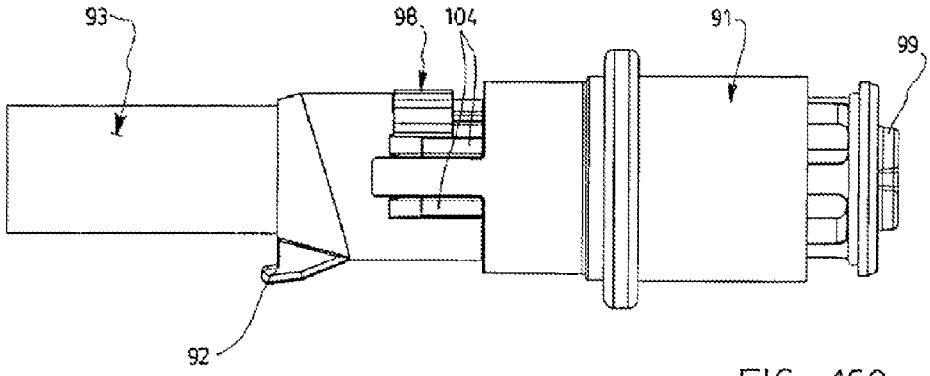
Figure 17A:
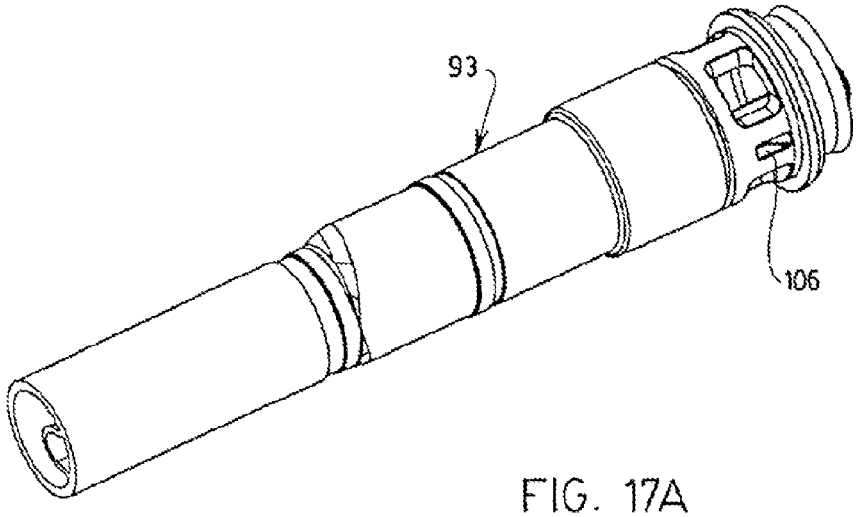
FIGS. 17A and 17B are isometric and cross-sectional views, respectively, of the second tube of the third pouring spout example.
Figure 17B:
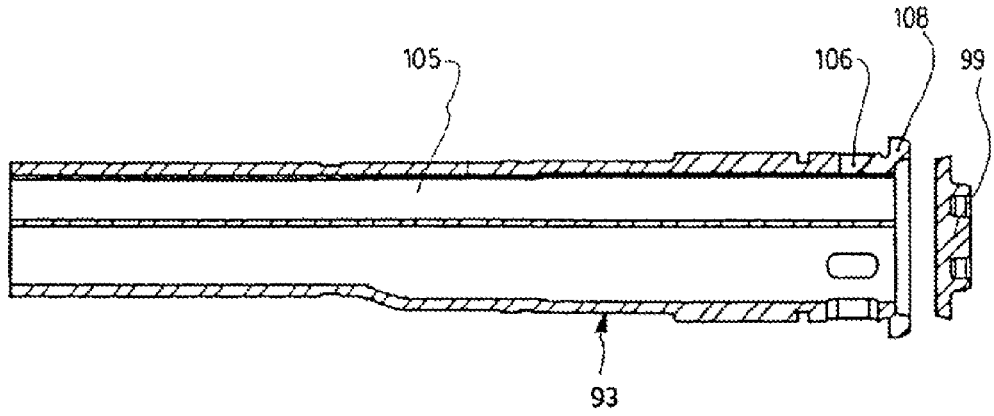
Figure 18:
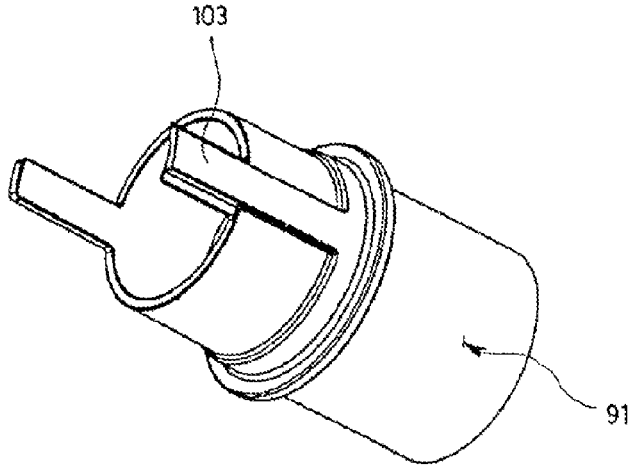
FIG. 18 is an isometric view of the first tube of the third pouring spout example.
Figure 19:
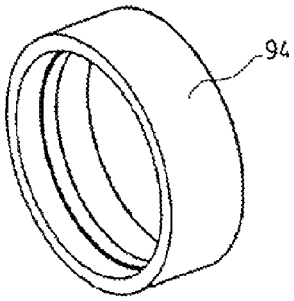
FIG. 19 is an isometric view of the retaining ring of the third pouring spout example.
Figure 20:
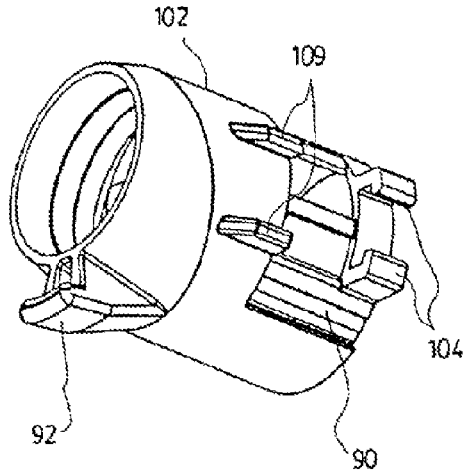
FIG. 20 is an isometric view of the assembling ring of the third pouring spout example.
Figure 21:
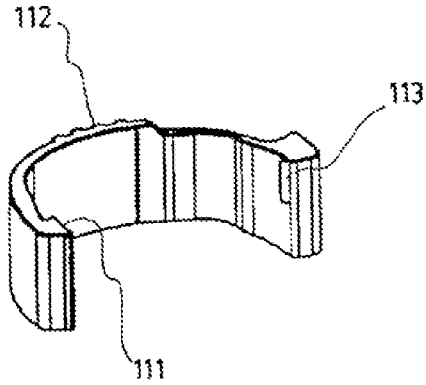
FIG. 21 is an isometric view of the childproof security system of the third pouring spout example.
Figure 22:
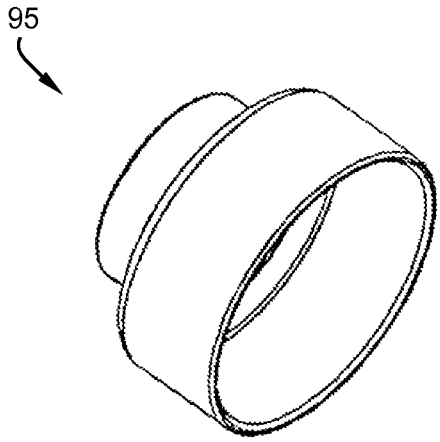
FIG. 22 is an isometric view of the cap of the third pouring spout example.
Figure 25A:
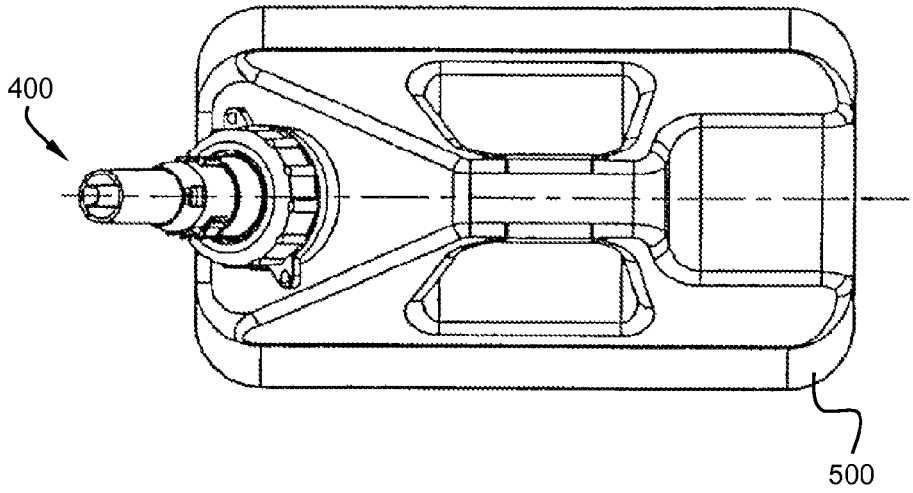
FIGS. 25A to 25D are views of the third pouring spout example when installed on a liquid-storage container.
Figure 25C:
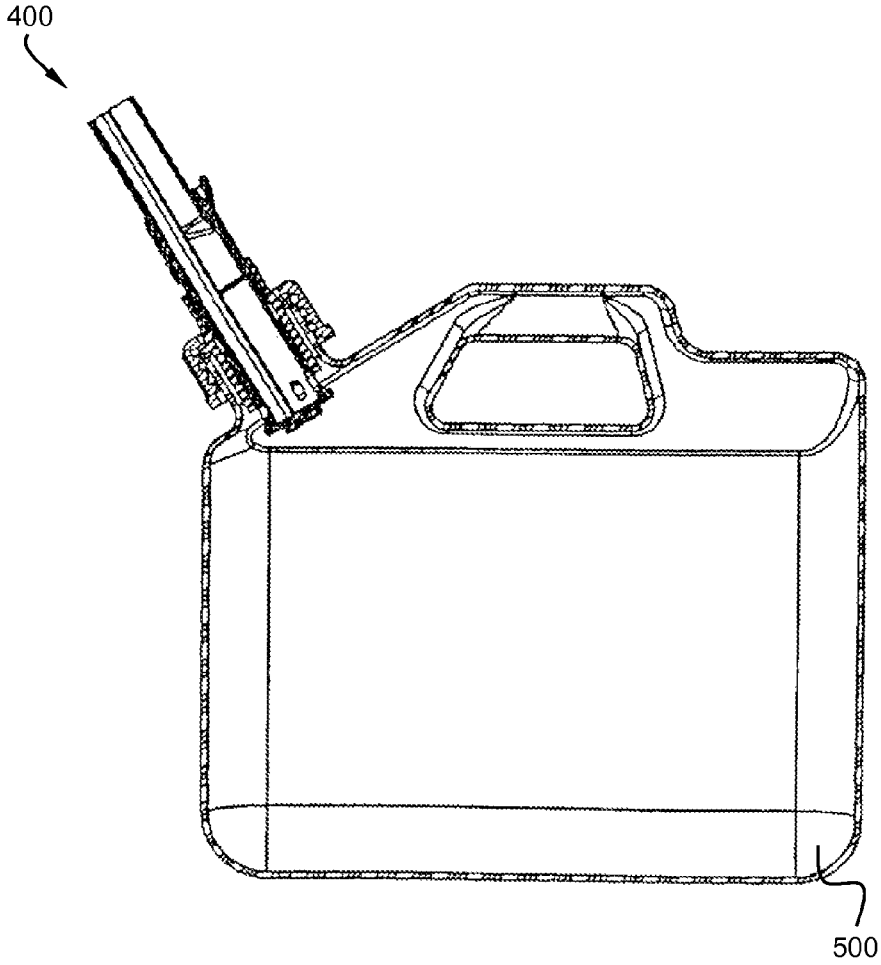
Figure 25B:
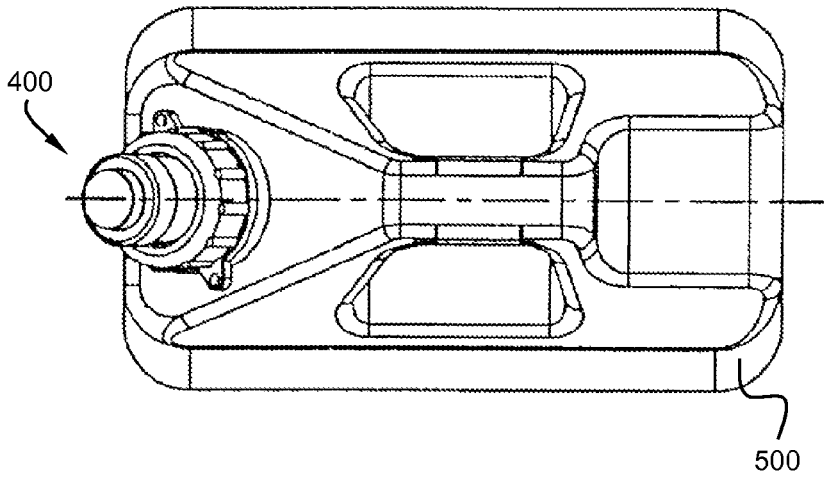
Figure 25D:
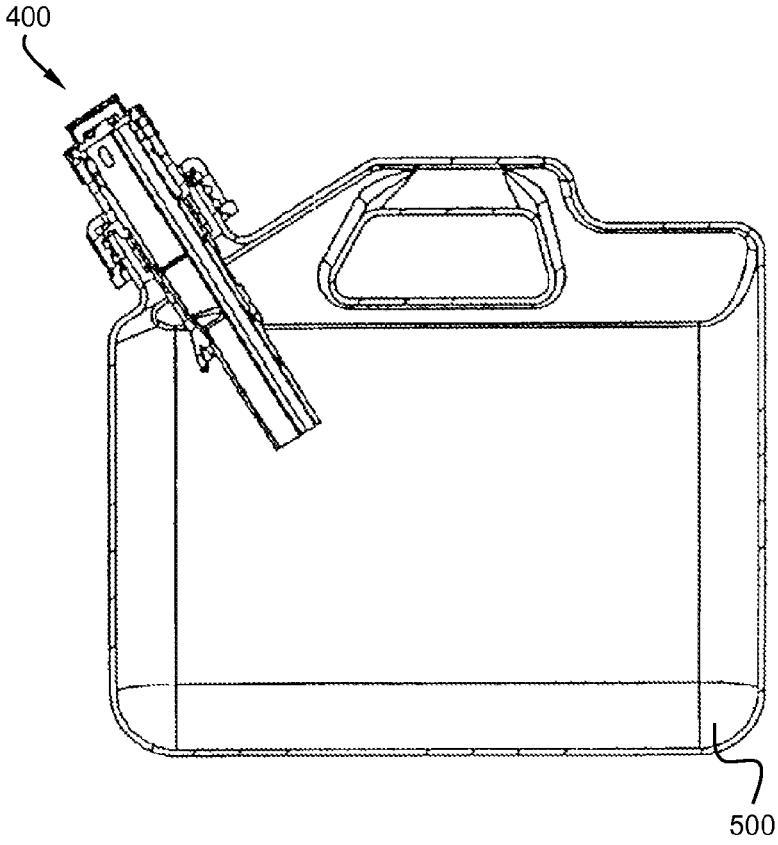

As shown in FIGS. 15A to 15C, a cap 95 can be used to stop dust and dirt from falling inside the third pouring spout example 400, thereby ensuring a clean filling and a better efficiency. This cap 95 is arranged to fit onto at least the outlet exit portion of the second tube 93 and optionally onto the first tube 91 in order to prevent undue entry of dust or dirt. The cap 95 can also be used to close the liquid-storage container 500 during the sale process and/or for security while transporting. It is also useful to close the liquid-storage container 500 when the third pouring spout example 400 is inside the liquid-storage container 500 as is shown in FIGS. 25B and 25D.

FIGS. 25A to 25D illustrate the third pouring spout example 400 described hereinabove, installed in, on, or in the liquid-storage container 500. It is worth noting that the third pouring spout example 400 may be installed outside of the liquid-storage container 500 for filling purposes, or installed in a reverse position, inside the liquid-storage container 500 for storage.

The connection to the liquid-storage container 500 can be made in various ways such as with the help of an annular cap 41, a fixed threaded base or any other type of adaptable base with or without threading in order to answer all the needs. The cap 41 can engage the annular flange 97 (FIGS. 15A, 15B, 16A and 16B) located at the first end of the pouring spout. In every case, the third pouring spout example 400 ensures liquid proofness thanks to its valve system.

As can also be noticed, the third pouring spout example 400 provide the same advantages as with the first and second pouring spout examples 200, 300.

Of course, numerous modifications can be made to the pouring spout examples disclosed hereinabove without departing from the scope of the invention as claimed hereinafter.

What is claimed is:

1. An auto-vented automatic stop flow pouring spout connectable to a liquid-storage container in order to pour by gravity a liquid stored in the liquid-storage container, the pouring spout having a first end and a second end, the pouring spout including a first tube detachably connectable to the liquid-storage container at the first end of the pouring spout, a second tube slideably connected to the first tube, and a liquid outlet duct and an air inlet duct, both uninterruptedly extending inside the first and second tubes between the first and second ends of the pouring spout, the liquid outlet duct and the air inlet duct being both selectively opened and closed with reference to the liquid-storage container only at the first end of the pouring spout to allow the liquid in the liquid-storage container to flow freely by gravity through the liquid outlet duct and out the second end of the pouring spout while air separately enters into the liquid-storage container via the air inlet duct, the liquid outlet duct and the air inlet duct being both selectively opened and closed with reference to the liquid-storage container by a spring-biased valve system having an open position and a closed position, the air inlet duct, when the valve system is moved from the closed position to the opened position, being initially made in fluid communication with the liquid-storage container only either simultaneously with the liquid outlet duct or immediately after the liquid outlet duct is initially made in fluid communication with the liquid-storage container, thereby preventing the liquid in the liquid-storage container from filling the air inlet duct when the liquid is poured using the pouring spout and minimizing evaporation and permeability of the liquid on internal surfaces inside the pouring spout.

2. The pouring spout according to claim 1, further including a child-proof security system that has to be deactivated in order to allow the second tube to slide relative to the first tube and thus to open the valve system.

3. The pouring spout according to claim 1, wherein the second tube includes at least one external tooth that projects in such a manner as to allow in use the second tube to be pressed against a neck of a receiving container or tank to be filled and thus to cause the second tube to slide relative to the first tube and cause the valve system to open while also helping to support the weight of the liquid-storage container to which the pouring spout is connected.

4. The pouring spout according to claim 3, wherein the second tube includes an outlet exit portion that extends at an angle in order to facilitate insertion of the outlet exit portion into the neck of the receiving container or tank to be filled.

5. The pouring spout according to claim 1, further including sealing means to make the first and second tubes leak-proof.

6. The pouring spout according to claim 4, further including a cap arranged to fit onto at least the outlet exit portion of the second tube and optionally onto the first tube in order to prevent undue entry of dust or dirt.

7. The pouring spout according to claim 1, wherein the second tube is slideably mounted externally onto the first tube and the valve system includes a single piece of elongated form that is slideably mounted internally within the first tube, the piece having one end that is rigidly connected to the second tube so as to be moved with the second tube relative to the first tube and that is divided into several longitudinal sections by means of radial walls so as to complete the liquid outlet duct and the air inlet duct of the second tube, the piece also having an opposite end shaped so as to act as a closing wall, the other end having a portion that is in registry with the air inlet duct and being of an angled hollow shape and provided with a narrow rectangular opening that permits a clear gradual opening of the air inlet duct separately from the opening of the liquid outlet duct when the piece is pushed by the second tube within the liquid-storage container in order.

8. The pouring spout according to claim 7, wherein the piece acting as the valve system also includes one or more transversal walls that are positioned in such a manner as to regulate and control the liquid flow when the same passes through the pouring spout.

9. The pouring spout according to claim 1, wherein the second tube is slideably mounted externally onto the first tube and the valve system includes a bascule valve pivotally mounted at an extremity of a holding tube that is part of the second tube and is arranged so as to extend within the first tube and to act as part of the air inlet duct and as a support and a guide for the internal spring of the pouring spout, the holding tube passing through a holding ring that is part of the first tube and arranged so as to retain the internal spring, the bascule valve being mounted onto the holding tube by means of a support that is part of the bascule valve and is provided with a U-shaped recess which is positioned so as to be in registry with the holding tube and thus to allow and control air entrance within the liquid-storage container when the pouring spout is activated, the bascule valve in closed position extending fully across the first tube and thus preventing both air and liquid from passing into the first tube, the first tube and the bascule valve including stoppers positioned so as to guide and stop the bascule valve in closed position.

10. The pouring spout according to claim 9, wherein the bascule valve is provided with a peripheral seal that comes into contact with the first tube when the valve system is closed and thus makes the bascule valve spill-proof.

11. The pouring spout according to claim 1, wherein the second tube is slideably mounted internally within the first tube and includes an inlet portion which is arranged so as to act as the valve system, the inlet portion comprising a valve head that externally projects from the inlet portion so as to come into contact with the second tube when the pouring spout is closed, the valve head being closed by an end wall so as to complete the closing of the pouring spout, the inlet portion acting as the valve system also including a hole made into the second tube close to the valve head so as to give access to the air inlet duct integrated to the second tube, and one or more other holes also made close to the valve head so as to give separate access to the liquid outlet duct also integrated to the second tube, the holes opening the air inlet duct and liquid outlet duct when the second tube is pushed back within the first tube.

* * * * *